US007784921B2

(12) United States Patent
Nagashima

(10) Patent No.: US 7,784,921 B2
(45) Date of Patent: Aug. 31, 2010

(54) LIQUID EJECTION HEAD AND IMAGE FORMING APPARATUS

(75) Inventor: Kanji Nagashima, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 659 days.

(21) Appl. No.: 11/822,365

(22) Filed: Jul. 5, 2007

(65) Prior Publication Data

US 2008/0018684 A1 Jan. 24, 2008

(30) Foreign Application Priority Data

Jul. 19, 2006 (JP) ..... 2006-197297

(51) Int. Cl.
*B41J 2/045* (2006.01)
*B41J 29/38* (2006.01)

(52) U.S. Cl. ..... 347/70; 347/10

(58) Field of Classification Search ..... 347/10, 347/68, 70–72

See application file for complete search history.

(56) References Cited

U.S. PATENT DOCUMENTS 4,468,679 A 8/1984 Suga et al.
6,155,670 A * 12/2000 Weber et al. ..... 347/43
6,478,414 B2 * 11/2002 Jeanmaire ..... 347/77
7,380,895 B2 * 6/2008 Sugahara ..... 347/9
2004/0263547 A1 12/2004 Sugahara

FOREIGN PATENT DOCUMENTS

JP 57-185159 A 11/1982
JP 2003-505281 A 2/2003
JP 2005-35271 A 2/2005
WO WO 01/08888 A1 2/2001

* cited by examiner

*Primary Examiner*—An H Do
(74) *Attorney, Agent, or Firm*—Birch, Stewart, Kolasch & Birch, LLP

(57) ABSTRACT

A liquid ejection head which forms an image, has: a nozzle from which liquid is ejected in a combination ejection direction and which includes a first nozzle region and a second nozzle region demarcated by a partition; a pressure chamber unit which includes a first pressure chamber connected to the first nozzle region and a second pressure chamber connected to the second nozzle region, the first pressure chamber and the second chamber being demarcated by the partition; and a single piezoelectric element which vibrates the first pressure chamber at a first resonance frequency and the second pressure chamber at a second resonance frequency in accordance with an electric field applied to the single piezoelectric element, the first resonance frequency being different from the second resonance frequency.

12 Claims, 21 Drawing Sheets

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to a liquid ejection head and an image forming apparatus in which the direction of ejection of liquid can be controlled.

2. Description of the Related Art

As an image forming apparatus, an inkjet recording apparatus (inkjet printer) has been known, which includes an inkjet printer head (liquid ejection head) having an arrangement of a plurality of liquid ejection nozzles and which records an image on a recording medium by ejecting ink (liquid) from the nozzles toward the recording medium while causing the inkjet head and the recording medium to move relatively to each other.

The inkjet head of the inkjet printer of this kind has pressure generating units, each including, for example, a pressure chamber to which ink is supplied from an ink tank through an ink supply channel, a piezoelectric element which is driven by an electrical signal in accordance with image data, a diaphragm which serves as a portion of the pressure chamber and deforms in accordance with the driving of the piezoelectric element, and a nozzle which is connected to the pressure chamber and from which the ink inside the pressure chamber is ejected in the form of a droplet due to the volume of the pressure chamber being reduced by the deformation of the diaphragm. In the inkjet printer, one image is formed on a recording medium, such as a paper, by combining dots formed by the ink droplets ejected from the nozzles of the pressure generating units.

In the inkjet printer, normally, a plurality of nozzles which eject ink directly are aligned in one row, and the ink ejected from a certain nozzle is deposited at a prescribed position. In this case, the depositing position is substantially uniform, and therefore the image resolution of the formed image is dependent on the nozzle pitch. Hence, by narrowing the nozzle pitch in order to form an image of high quality, it is possible to achieve a higher resolution in the image.

As a method for obtaining high-quality images, there has been also another method which increases the number of tonal graduations of the pixels which make up the image. However, in an inkjet system, there are limitations on the number of tonal graduations available for one pixel, and unlike the case of a dye sublimation printer, it is difficult to obtain a high number of graduated tones. More specifically, in order to obtain tonal graduations in one pixel in the inkjet system, it is necessary to adjust the ink ejection volume, and therefore, if it is sought to achieve tonal graduations by means of a single nozzle, the upper limit for the number of tones is generally around 16. In order to increase the number of tones yet further, there have been methods in which inks respectively having dark and light hues of the same color are provided separately, and the number of tonal graduations is increased by controlling the use of these inks. However, even though this special system is adopted, unlike the case of a dye sublimation printer, it has been difficult to obtain 256 tones for each color in one pixel.

Therefore, in the inkjet head, a high-resolution image is generally obtained by increasing the pixel density, as described above. More specifically, there is a correlation between the number of tonal graduations in one pixel and the density of the pixels, and even if the number of tonal graduations is small, provided that the pixel density is high, then it is possible for the image to be perceived as an image of high resolution. Although there are differences among individuals, human visual spatial resolution is normally limited to a resolution of approximately 0.05 mm to 0.1 mm. Therefore, if the image density is 250 dots per inch (dpi) to 500 dpi or greater, then it is not possible to recognize mutually adjacent pixels as separate pixels. Hence, as long as an image has the pixel density of a particular value or above, the method of achieving a high-resolution image may be based on the method of increasing the number of tonal graduations in one pixel, or based on the method of increasing the pixel density, and in the inkjet system, high resolution is normally achieved by means of the latter method. Moreover, even in the case of monochrome printing, it is possible to make the font lines even smoother by increasing the pixel density.

Consequently, at present, a high-resolution inkjet head of approximately 1200 dpi can be developed practically, but if it is sought to obtain an image of even higher resolution, then it is necessary to reduce the nozzle pitch in the inkjet head, as described above. However, since the inkjet head includes pressure chambers and nozzles for ejecting liquid, then there are structural limitations on the extent to which the nozzle pitch can be reduced. Moreover, in order to obtain an image of high resolution at high speed, there is a method which uses an inkjet head having a width corresponding to one edge of the recording medium, such as paper. However, if color printing is to be carried out at an image density of 1200 dpi onto A3 size paper, then approximately 60,000 nozzles are required, and it is extremely difficult to manufacture this inkjet head with good production yield. Further, in order to drive an inkjet head having an extremely large number of nozzles, the control circuit also becomes highly complex, and this causes increased costs and reduced reliability in the inkjet head, and hence, in the image forming apparatus. This problem can be resolved provided that the actions of a plurality of nozzles can be achieved by means of one nozzle.

With regard to the quality of the image formed by the inkjet head, aside from the effects of the number of pixels and tonal graduations described previously, the effects of the quality of each individual pixel formed by the inkjet head are not negligible. More specifically, the ink droplets ejected from the inkjet head deposit on a recording medium to form an image, but the depositing position, shape and size of the deposited droplet that forms a pixel also affect the quality of the image formed. Of these factors, the ink depositing position is particular important since displacement of the depositing position has a large effect on the quality of the image. In the inkjet head, since a plurality of nozzles are normally aligned in one row, then displacement of the depositing position of the ink droplet in a direction that is perpendicular to the direction in which the nozzles are aligned (namely, in the direction of movement of the inkjet head), can be resolved by controlling the ejection timing of the ink. However, any displacement of the depositing position of the ink droplet in the direction which is parallel to the direction in which the nozzles are aligned (namely, in the direction perpendicular to the direction of movement of the inkjet head), cannot be resolved by controlling ejection timing of the ink, and in order to resolve this, it is necessary to control the flight direction of the ink droplet ejected from the nozzles.

Moreover, even in cases where no displacement of the depositing position occurs, by controlling the flight direction of the ink droplet ejected from the nozzles, it is possible to make the ink deposit at desired positions more accurately, and hence the resolution of the formed image can be increased even further.

In view of these circumstances, research has been carried out into controlling the flight direction of ink droplets ejected from nozzles, and one method for achieving this is a method based on electrostatic deflection. In this method, a pair of deflecting electrodes are provided so that charged ink droplets fly therebetween, and the flight direction of the ink droplet is deflected by means of the deflecting electric field. However, in this method, it is necessary to provide deflecting electrodes between the recording medium and the nozzles, and hence it is necessary to provide a large interval between the recording medium and the nozzles. The larger this interval, the greater the external disturbance that affects the ink droplets in flight and the more likely there is to be variation in the flight direction, which results in deterioration in the quality of the image. Moreover, in the method based on electrostatic deflection, since the angle of deflection of the ink flight direction is inversely proportional to the speed of flight of the ink droplet, then the angle of deflection varies depending on the speed of flight of the ink droplet. Consequently, it has been difficult to control the deflection and to thereby obtain an image of high resolution by means of the method based on electrostatic deflection only.

Apart from this method, there are methods for controlling the flight direction of the ink droplets ejected from the nozzles. For example, Japanese Patent Application Publication Nos. 57-185159 and 2005-35271 disclose that a plurality of nozzles that have mutually different ejection directions and eject ink droplets to be unified into one ink droplet are provided, and that by adjusting the speed of flight, and the like, of an ink droplet ejected from each nozzle, it is possible to control the flight direction of the unified ink droplet.

Moreover, ink blockages are liable to occur in the inkjet system since the ink used in an inkjet system is a liquid. Japanese National Publication of International Patent Application No. 2003-505281 discloses an invention which prevents the ink blockages by causing ink to flow inside the pressure chambers.

However, in the inventions disclosed in Japanese Patent Application Publication Nos. 57-185159 and 2005-35271, for one united liquid droplet to be ejected, it is necessary to provide at least two nozzles, two pressure chambers and two piezoelectric elements, and the like, and it is necessary to adopt a composition which ejects at least two liquid droplets. Consequently, it is difficult to manufacture the liquid ejection head of this complicated structure, and moreover it is difficult to achieve this technology in practice since it is necessary to control the nozzles independently and the composition for controlling the flight direction is hence complicated.

SUMMARY OF THE INVENTION

The present invention has been contrived in view of these circumstances, an object thereof being to provide a liquid ejection head which has a simple, inexpensive and highly practicable composition, is capable of forming an image of high resolution, and is capable of controlling the ejection direction of the ink (flight direction of an ink droplet).

In order to attain the aforementioned object, the present invention is directed to a liquid ejection head which forms an image, comprising: a nozzle from which liquid is ejected in a combination ejection direction and which includes a first nozzle region and a second nozzle region demarcated by a partition; a pressure chamber unit which includes a first pressure chamber connected to the first nozzle region and a second pressure chamber connected to the second nozzle region, the first pressure chamber and the second chamber being demarcated by the partition; and a single piezoelectric element which vibrates the first pressure chamber at a first resonance frequency and the second pressure chamber at a second resonance frequency in accordance with an electric field applied to the single piezoelectric element, the first resonance frequency being different from the second resonance frequency, wherein: the liquid in the first nozzle region is ejected in a first ejection direction at a first ejection speed and the liquid in the second nozzle region is ejected in a second ejection direction different from the second ejection direction at a second ejection speed in such a manner that the liquid ejected from the first nozzle region and the liquid ejected from the second nozzle region combine together at an end of the nozzle; and the combination ejection direction in which the liquid is ejected from the nozzle is controlled by adjusting a waveform of the electric field applied to the single piezoelectric element so that the first ejection speed of the liquid ejected from the first nozzle region is different from the second ejection speed of the liquid ejected from the second nozzle region.

In this aspect of the present invention, it is possible to control the liquid ejection direction by adjusting the waveform of the electric field applied to the single piezoelectric element, and since the number of drive circuits for the piezoelectric element can be reduced (for example, the single drive circuit for the piezoelectric element can be achieved), then cost reductions can be achieved.

Preferably, the liquid ejection head further comprises a diaphragm which forms a wall of the first pressure chamber and a wall of the second pressure chamber, wherein the single piezoelectric element is formed on a first surface of the diaphragm reverse to a second surface where the first pressure chamber and the second pressure chamber are formed.

In this aspect of the present invention, the diaphragm and the piezoelectric element are bonded together to form a combined bimorph structure, and therefore it is possible to increase the displacement of the piezoelectric body and a large displacement can be obtained accordingly. Hence, a plurality of pressure chambers can be driven by means of a single piezoelectric element, thus achieving very good efficiency.

Preferably, the liquid ejection head further comprises an elastic body provided between the diaphragm and the partition.

In this aspect of the present invention, since the pressure loss generated when the piezoelectric element is driven is reduced, then the usage efficiency of the force generated by the piezoelectric element is increased.

Preferably, the partition is partially or entirely composed of the single piezoelectric element.

In this aspect of the present invention, a composition can be adopted in which the pressure chambers and the partition composed of the piezoelectric element are arranged in one direction, and hence the manufacturing process can be simplified.

Preferably, the liquid ejection head further comprises a nozzle flow channel which connects the first nozzle region with the second nozzle region at the end of the nozzle, wherein the liquid flows between the first nozzle region and the second nozzle region via the nozzle flow channel, by making a first pressure in a first supply channel connected to the first pressure chamber different from a second pressure in a second supply channel connected to the second pressure chamber.

In this aspect of the present invention, when liquid of increased viscosity in the nozzle is not ejected, then it is possible to expel this liquid to one of the liquid supply channels, and therefore it is possible to prevent the occurrence of ejection errors even in the cases where no ejection is performed for a long period of time. Moreover, by combining this composition with the above-described composition where the elastic body is provided between the diaphragm and the partition, then it is possible to reduce the pressure required to make the liquid flow, and hence the efficiency of expelling liquid to one of the liquid supply channels can be improved.

Preferably, the combination ejection direction in which the liquid is ejected from the nozzle is controlled by adjusting an application time of the electric field applied to the single piezoelectric element.

In this aspect of the present invention, it is possible to control the liquid ejection direction by adjusting the application time (width of the applied pulse) of the electric field applied to the single piezoelectric element. High resolution and high accuracy can be achieved readily in the case of this adjustment of the application time (width of the applied pulse) of the electric field, and therefore it is possible to reduce the cost of the piezoelectric element control circuit.

Preferably, an application end time when application of the electric field to the single piezoelectric element is halted, is kept substantially constant irrespective of the application time of the electric field.

In this aspect of the present invention, even in the case where droplets are ejected with different application times for the electric field applied to the piezoelectric element, in different ejection directions, it is still possible to make the depositing positions of these droplets coincide in terms of the direction of relative movement of the head to the recording medium, which is perpendicular to the ejection control direction.

Preferably, the electric field applied to the single piezoelectric element is adjusted in such a manner that timing when the liquid is ejected from the nozzle is kept substantially constant irrespective of the application time of the electric field.

Preferably, a magnitude of the electric field is controlled in accordance with the application time of the electric field applied to the single piezoelectric element so that a droplet volume of the liquid ejected from the nozzle is kept substantially constant.

In this aspect of the present invention, a uniform liquid ejection volume can be maintained while the liquid ejection direction is controlled, and therefore an image of high quality can be obtained. Moreover, since the ejection direction can be controlled on the basis of the application time and the ejection volume can be controlled on the basis of the magnitude of the electric field, then the control procedure is facilitated and the composition of the drive circuit can be simplified.

Preferably, the nozzle further includes a third nozzle region demarcated by the partition; the pressure chamber unit further includes a third pressure chamber which is demarcated by the partition and which is connected to the third nozzle region; the single piezoelectric element vibrates the third pressure chamber at a third resonance frequency in accordance with the electric field applied to the single piezoelectric element, the third resonance frequency being different from the first resonance frequency and the second resonance frequency; the liquid in the third nozzle region is ejected in a third ejection direction at a third ejection speed in such a manner that the liquid ejected from the first nozzle region, the liquid ejected from the second nozzle region and the liquid ejected from the third nozzle region combine together at the end of the nozzle, the third ejection direction being different from the first ejection direction and the second ejection direction; and the combination ejection direction of the liquid ejected from the nozzle is controlled by adjusting the waveform of the electric field applied to the single piezoelectric element so that the first ejection speed of the liquid ejected from the first nozzle region, the second ejection speed of the liquid ejected from the second nozzle region and the third ejection speed of the liquid ejected from the third nozzle region are different from each other.

In this aspect of the present invention, it is possible to control the liquid ejection direction two-dimensionally, and it is possible to form an image of even higher quality.

In order to attain the aforementioned object, the present invention is also directed to a liquid ejection apparatus comprising any one of the liquid ejection heads described above.

Moreover, in order to attain the aforementioned object, the present invention is also directed to an image forming apparatus comprising any one of the liquid ejection heads described above.

In these aspects of the present invention, it is possible to obtain an image of high quality at low cost.

With a liquid ejection head according to the present invention, it is possible to control the ejection direction of liquid easily, and it is possible readily to obtain an image of high resolution and high quality. Moreover, with a liquid ejection head according to the present invention, each of the nozzle and the pressure chamber unit is divided into a plurality of spaces by means of a partition, then the structure is extremely simple, and furthermore, since the control of one piezoelectric element for deforming the plurality of pressure chambers is achieved by using a single drive waveform, then it is possible to use a highly simple control circuit. Consequently, the manufacturing process can be simplified, and the load on the control circuit can be reduced. As a result, in an image forming apparatus including this liquid ejection head, beneficial effects are obtained in that an image of high resolution can be obtained readily at low cost.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Structure of Liquid Election Head

The structure of an inkjet head which forms a liquid ejection head according to an embodiment of the present invention is described below with reference to FIG. 1.

Figure 1:
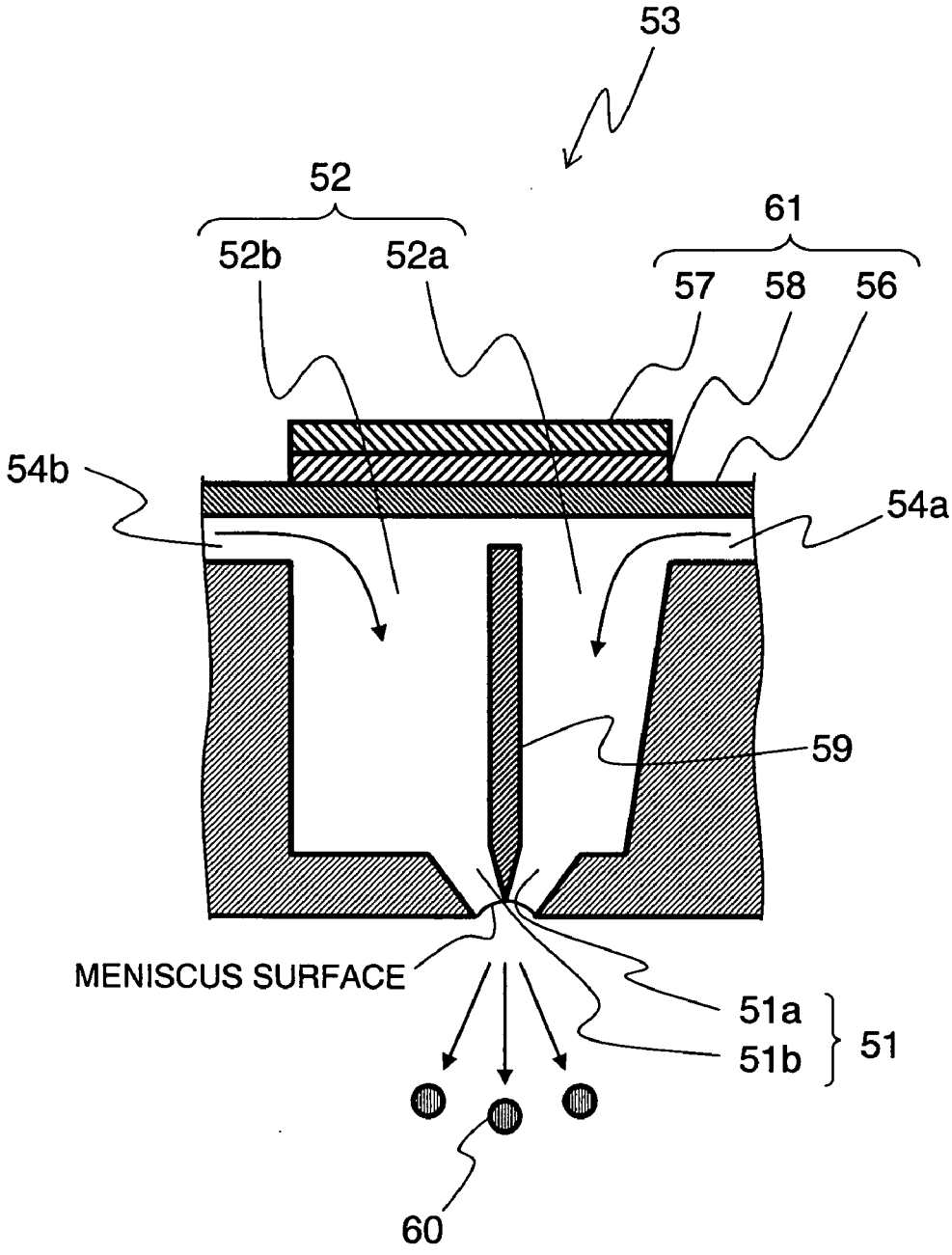
FIG. 1 is a cross-sectional diagram of a liquid ejection head according to a first embodiment of the present invention.
Figure 2:
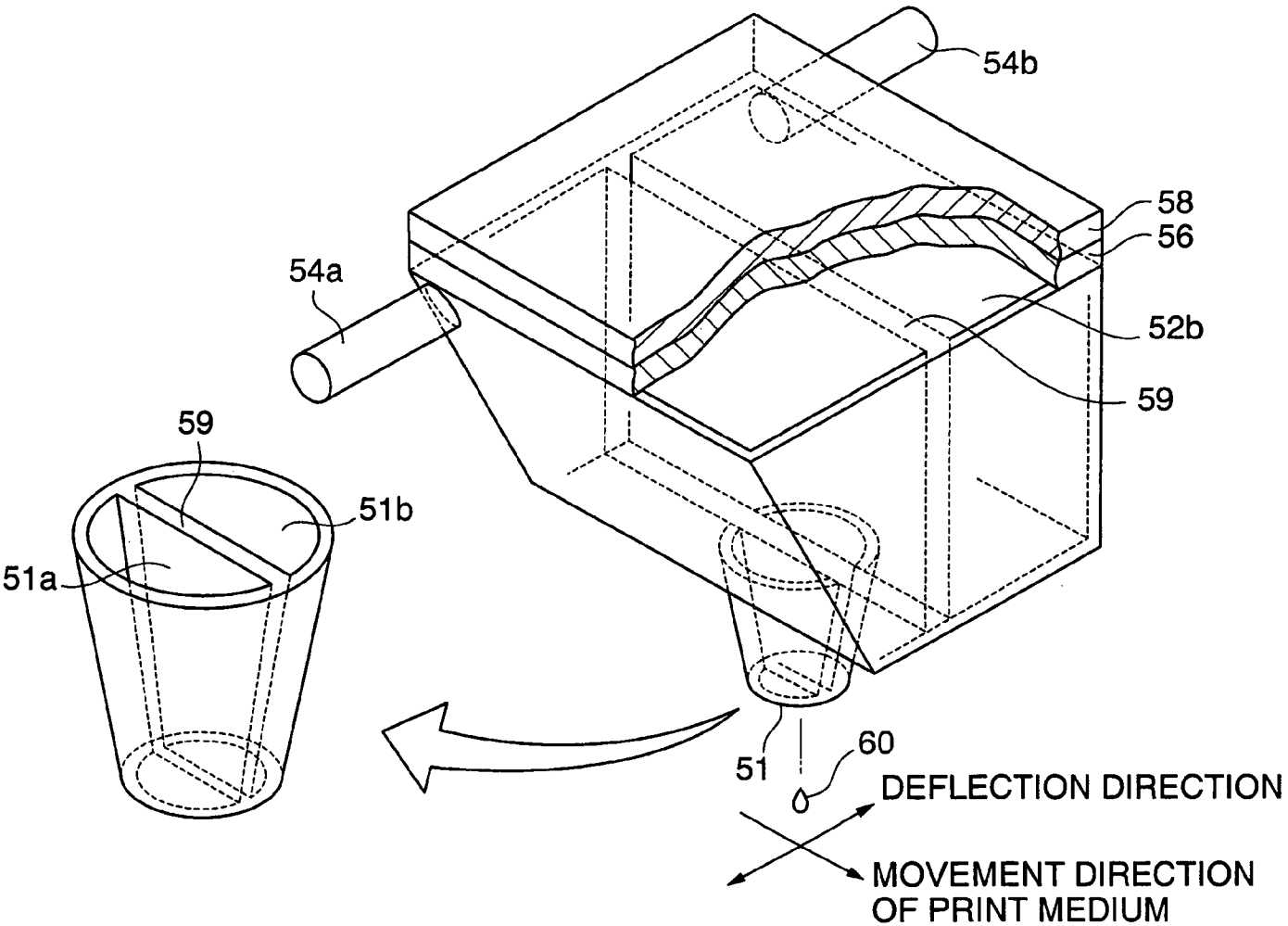
FIG. 2 is a perspective diagram of a liquid ejection head according to the first embodiment.

FIG. 1 is a cross-sectional diagram showing the composition of an ink chamber unit of an inkjet head according to the present embodiment. FIG. 2 is a perspective diagram showing one portion of the composition of an ink chamber unit of the inkjet head according to the present embodiment.

As shown in FIG. 1, a nozzle 51 constituting an ink chamber unit 53 includes a first nozzle region 51*a* and a second nozzle region 51*b* which are demarcated by means of a partition wall 59 up to the front end of the ink ejection part. Similarly, the pressure chamber 52 is also separated into a first pressure chamber 52*a* and a second pressure chamber 52*b* by means of the partition 59. The first nozzle region 51*a* connects to the first pressure chamber 52*a*, while the second nozzle region 51*b* connects to the second pressure chamber 52*b*. The first pressure chamber 52*a* connects to a common liquid chamber (not illustrated) via a first ink supply channel 54*a*, and ink is supplied to the first pressure chamber 52*a* from the common liquid chamber. Similarly, the second pressure chamber 52*b* connects to the common liquid chamber (not illustrated) via a second ink supply channel 54*b*, and ink is supplied to the second pressure chamber 52*b* from the common liquid chamber.

A diaphragm 56 forms one of the walls that define the first pressure chamber 52*a* and the second pressure chamber 52*b*, and in other words, the diaphragm 56 constitutes a common wall of the pressure chambers 52*a* and 52*b*. A piezoelectric layer 58 is formed on a surface of the diaphragm 56 reverse to a surface on which the pressure chamber 52 is formed. Moreover, an upper electrode 57 is formed on top of this piezoelectric layer 58. The diaphragm 56 also functions as an electrode, and the piezoelectric layer 58 is caused to deform by applying an electric field between the upper electrode 57 and the electrode forming the diaphragm 56, the volumes of the first pressure chamber 52*a* and the second pressure chamber 52*b* are changed, and hence a pressure can be applied to the ink inside each of the pressure chambers 52*a* and 52*b*. The ink subjected to this pressure is ejected in the form of a droplet (an ink droplet 60) from the nozzle 51 constituted by the first nozzle region 51*a* and the second nozzle region 51*b*. The piezoelectric element 61 which serves as an actuator in the present embodiment is constituted by the diaphragm 56, the piezoelectric layer 58 and the upper electrode 57, and in some cases, this piezoelectric element 61 is also referred to as an ultrasonic wave generating element.

The nozzle 51 is divided by the partition 59 into the first nozzle region 51*a* and the second nozzle region 51*b*, and the ink supplied from the nozzle region 51*a* and the ink supplied from the nozzle region 51*b* combine at the front end part of the first nozzle region 51*a* and the second nozzle region 51*b*, thereby forming an ink droplet 60 which is ejected from the nozzle 51. In this case, by changing the supply speeds (ejection speeds) of the ink in the nozzle region 51*a* and the nozzle region 51*b*, then it is possible to change and control the flight direction of the ink droplet 60 ejected from the nozzle 51. FIG. 1 shows examples of the flight directions of the ink 60, and only one ink droplet 60 is ejected from the nozzle 51 in a particular flight direction during one ejection operation. Moreover, in the present embodiment, the ink flight direction is not limited to the directions shown in FIG. 1, and it is possible to change the flight direction in a continuous fashion.

More specifically, it is possible to alter the resonance frequencies under free vibration of the first pressure chamber 52*a* and the second pressure chamber 52*b* respectively, by changing at least one of: the inertance of the ink supply channel, the compliance of the pressure chamber, the compliance of the actuator, and the inertance of the nozzle flow channel. It is thereby possible for the first pressure chamber 52*a* and the second pressure chamber 52*b* to have the mutually different resonance frequencies under free vibration that is generated by applying a pulse electric field to the piezoelectric element 61 forming an actuator.

It is also possible to change the resonance frequencies described above by means of the resistances of the ink supply channel and the nozzle flow channel, and the compliance of the meniscus. However, the resistances of the ink supply channel and the nozzle flow channel have a particularly great effect on the attenuation of the vibration, but have little effect on the resonance frequency compared to the above-described inertances; therefore, it is less effective to change the resistances for the purpose of controlling the resonance frequency. Moreover, the frequency that is considerably affected by varying the meniscus compliance is the frequency of the vibration in which the ink is drawn by the surface tension of the ink meniscus, and it is different from the resonance frequencies under free vibration in the pressure chambers 52*a* and 52*b*. Further, it is not desirable to change the meniscus compliance, since this leads to changing the diameter of the nozzle 51 and therefore has a great effect on the ink ejection volume.

Consequently, desirably, the parameters used to change the resonance frequencies of the pressure chambers 52*a* and 52*b* includes at least one of the inertance of the ink supply channel, the compliance of the pressure chamber, the compliance of the actuator, and the inertance of the nozzle flow channel.

As described below, the resonance frequencies can be changed on the basis of the inertance of the ink supply channel, by changing the internal diameters of the first ink supply channel 54*a* and the second ink supply channel 54*b*. More specifically, it is possible to increase the resonance frequencies by reducing these internal diameters. Similarly, the resonance frequencies can be changed on the basis of the nozzle inertance, by changing the cross-sectional areas in which the ink flows in the first nozzle region 51*a* and the second nozzle region 51*b*. More specifically, it is possible to increase the resonance frequencies by reducing the cross-sectional areas of the nozzle regions. However, if the inertance is changed, then the resistance is generally also changed; therefore, a method which changes the compliance to change the resonance frequency, as described hereinafter, is desirable.

It is possible to change the resonance frequencies on the basis of the pressure chamber compliances, by changing the volumes in the first pressure chamber 52*a* and the second pressure chamber 52*b*. More specifically, it is possible to increase the resonance frequencies by reducing these volumes.

The resonance frequencies can be changed on the basis of the actuator compliances, by changing the surface areas of the piezoelectric layer 58 that respectively cover the first pressure chamber 52*a* and the second pressure chamber 52*b* across the diaphragm 56. More specifically, by reducing these surface areas of the piezoelectric layer 58 which cover the diaphragm 56, it is possible to raise the resonance frequencies.

Based on the above-mentioned description, as shown in FIG. 1, the most desirable composition according to the present embodiment is one in which the pressure chamber compliance is changed by making the volume of the first pressure chamber 52*a* less than the volume of the second pressure chamber 52*b*, thereby raising the resonance frequency in the first pressure chamber 52*a*. By this means, the amplitude of the flow speed of the ink in the first pressure chamber 52*a* is increased and the flow speed becomes increased; therefore by reducing the surface area of the piezoelectric layer 58 covering the part of the diaphragm 56 corresponding to the first pressure chamber 52*a*, the compliance of the actuator is reduced, and the amplitude of the flow speed in the first pressure chamber 52*a* is reduced, thus making the flow speed slower. In this way, it is possible to achieve a balance of the flow speed between the first pressure chamber 52*a* and the second pressure chamber 52*b*.

Reducing the volume of the first pressure chamber 52*a* and reducing the surface area of the piezoelectric layer 58 covering the part of the diaphragm 56 forming the wall of the first pressure chamber 52*a* both result in the increase of the resonance frequency in the first pressure chamber 52*a*, and there is no contradiction between them in terms of design and hence the resonance frequency can be adjusted easily. Moreover, it is not necessary to change the shapes of the nozzle flow channel and the ink supply channels 54*a* and 54*b*, and hence the ink supply characteristics and the ink ejection characteristics, which are dependent on these shapes, do not change either; therefore, this composition is the most desirable from the viewpoint of design and manufacture. The composition described above is based on the viewpoints of design and manufacture, and from another viewpoint, it is also possible to change the resonance frequencies by altering other parameters, and therefore a liquid ejection head may also have a composition that is different from that described above.

In the present embodiment, only one actuator (single actuator; common piezoelectric element) is used in order to eject one liquid droplet, and the actuator compliances are adjusted by changing the surface areas of the piezoelectric layer 58 on the diaphragm 56 that respectively cover pressure chambers 52*a* and 52*b*. The diaphragm 56 forms a wall of each of the first pressure chamber 52*a* and the second pressure chamber 52*b*.

Resonance Frequency of Liquid Ejection Head

In order to describe the principles of embodiments of the present invention, the resonance frequencies of the liquid chambers in a liquid ejection head according to the present embodiment are described on the basis of the following equations.

The inertance of the ink supply channel, Ms, is expressed by the following equation:

$$Ms=Is\times\rho/As \quad (1),$$

where Ms is the inertance of the ink supply channel, Is is the length of the ink supply channel, As is the cross-sectional area of the ink supply channel, and ρ is the ink density.

The ink supply channel resistance Rs is expressed by the following equation:

$$Rs=32\times\eta\times Is/(As\times ds^2) \quad (2),$$

where Rs is the ink supply channel resistance, ds is the diameter of the ink supply channel (the diameter of the cross-section of the ink supply channel), and η is the viscosity of the ink.

The inertance of the nozzle flow channel, Mn, is expressed by the following equation:

$$Mn=In\times\rho/An \quad (3),$$

where Mn is the inertance of the nozzle flow channel, In is the length of the nozzle flow channel, and An is the cross-sectional area of the nozzle flow channel.

The resistance of the nozzle flow channel, Rn, is expressed by the following equation:

$$Rn=32\times\eta\times In/(An\times dn^2) \quad (4),$$

where Rn is the resistance of the nozzle flow channel, dn is the diameter of the nozzle flow channel (the diameter of the cross-section of the nozzle flow channel).

The compliance of the pressure chamber, Cc, is expressed by the following equation:

$$Cc=V/(\rho\times v^2) \quad (5),$$

where Cc is the compliance of the pressure chamber, V is the volume of the pressure chamber, and v is the speed of sound in ink.

The meniscus compliance Cn is expressed by the following equation:

$$Cn=\pi\times(dn/2)^4/(3\times\gamma) \quad (6),$$

where Cn is the meniscus compliance, and γ is the surface tension of the ink.

The actuator compliance Ca is expressed by the following equation:

$$Ca=\mathrm{Vol}/P0 \quad (7),$$

where Ca is the actuator compliance, Vol is the deformation volume of the actuator, and P0 is the pressure generated by the actuator.

From the above, the attenuation coefficient Dn and the resonance frequency En are expressed by the following equations:

$$Dn=Rn/(2\times Mn) \quad (8),$$

$$En=(2/(Mn\times(Ca+Cc))-Dn^2)^{1/2}/2\pi \quad (9).$$

In general, a good balance is achieved between the ink ejection volume from the nozzle and the ink supply performance, by making the ink volume flowing from the common liquid chamber to the ink supply channel equal to the ink volume flowing to the nozzle flow channel, and therefore it is presumed that "Ms=Mn" and "Rs=Rn".

On the basis of the above, the resonance frequencies of the first pressure chamber 52*a* and the second pressure chamber 52*b* under the following conditions are described below.

(Physical Properties of Ink)
ρ (ink density): 1 (g/cm$^3$)
η (ink viscosity): 20 (cp)
v (speed of sound in ink) 1500 (m/sec)
γ (surface tension of ink): $35\times10^{-3}$ (N/m)

(First Pressure Chamber)
Is (length of ink supply channel): 30 (μm)
As (cross-sectional area of ink supply channel): $7.069\times10^{-10}$ (m$^2$)
ds (diameter of ink supply channel): 30 (μm)
In (length of nozzle flow channel): 30 (μm)
An (cross-sectional area of nozzle flow channel): $7.069\times10^{-10}$ (m$^2$)
dn (diameter of nozzle flow channel): 30 (μm)
V (pressure chamber volume): $0.195\times0.154\times0.15$ (mm$^3$)=$0.45\times10^4$ (pl)
Vol (volume change by actuator): 13 (pl)
P0 (pressure generated by actuator): $2\times10^6$ (Pa)

(Second Pressure Chamber)
Is (length of ink supply channel): 30 (μm)
As (cross-sectional area of ink supply channel): $7.069\times10^{-10}$ (m$^2$)
ds (diameter of ink supply channel): 30 (μm)
In (length of nozzle flow channel): 30 (μm)
An (cross-sectional area of nozzle flow channel): $7.069\times10^{10}$ (m$^2$)
dn (diameter of nozzle flow channel): 30 (μm)
V (pressure chamber volume): $0.3\times0.3\times0.15$ (mm$^3$)=$1.35\times10^4$ (pl)
Vol (volume change by actuator): 20 (pl)
P0 (pressure generated by actuator): $2\times10^6$ (Pa)

From the above, the resonance frequency En1 in the first pressure chamber 52*a* is 370 (kHz), and the resonance frequency En2 in the second pressure chamber 52*b* is 267 (kHz).

Ejection Control of the Liquid Ejection Head

On the basis of the foregoing, the control of deflection of the ink flight direction in the liquid ejection head according to the present embodiment is described below.

Figure 3:
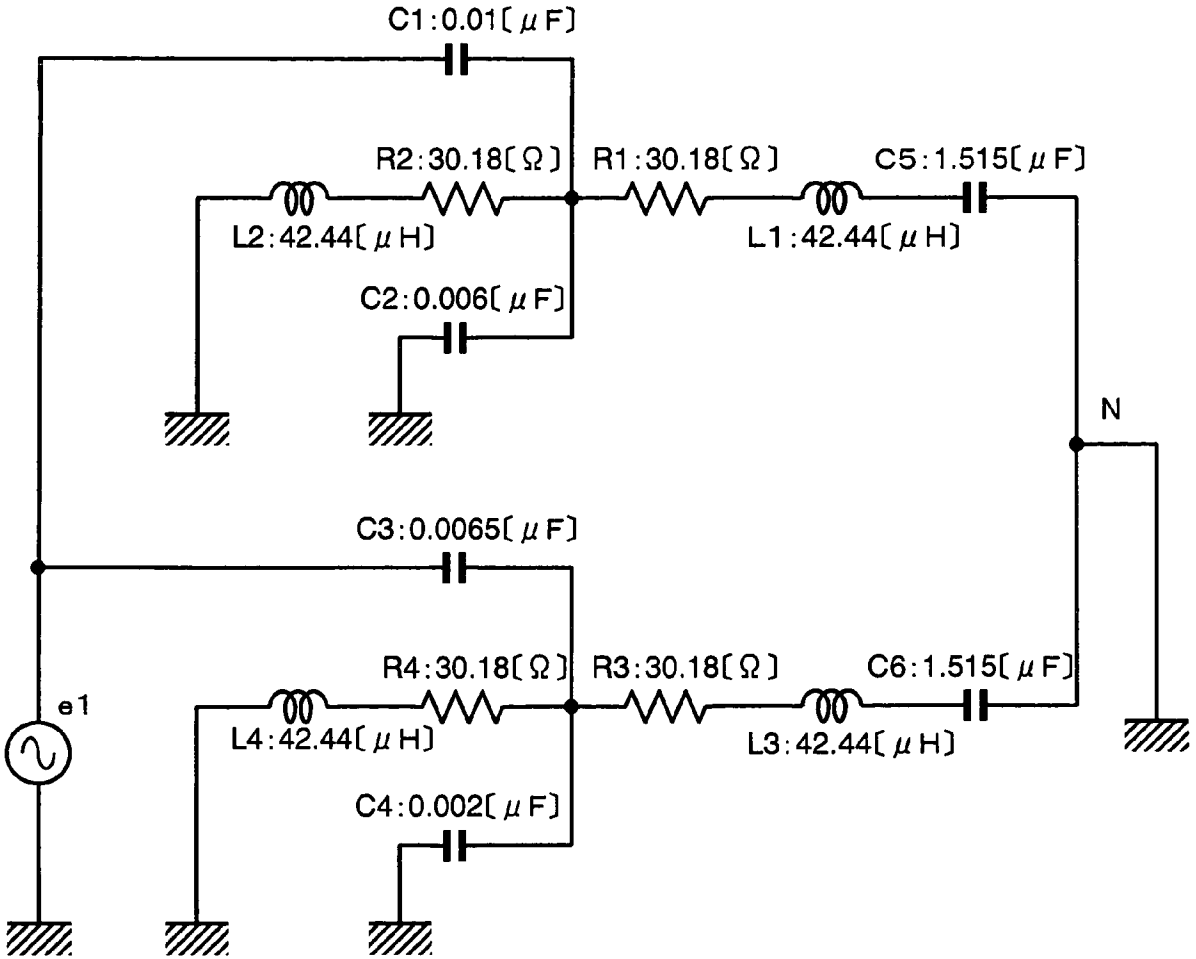
FIG. 3 is an equivalent circuit diagram of a liquid ejection head according to an embodiment of the present invention.

FIG. 3 is an example of an equivalent circuit for the ink chamber unit 53 according to the present embodiment. More specifically, the voltage in the equivalent circuit shown in FIG. 3 corresponds to the pressure, and the current corresponds to the volumetric flow speed (unit: cm$^3$/sec). The flow speed (unit: cm/sec) is obtained by dividing this volumetric flow speed by the cross-sectional area, and the flow volume (unit: cm$^3$) is obtained by integrating the volumetric flow speed.

The following description is principally based on the volumetric flow speed, but if the cross-sectional area is constant, then the flow speed is directly proportional to the volumetric flow speed, and hence there are cases where the volumetric flow speed is indicated simply as the flow speed in the present specification. In the cases where numeral values are stated, the units of volumetric flow speed are specified.

The symbols in the equivalent circuit in FIG. 3 indicate the following parameters.

e1: input waveform
C3: compliance Ca of actuator in first pressure chamber 52*a*
C4: compliance Cc of first pressure chamber 52*a*
C6: meniscus compliance Cn of first pressure chamber 52*a*
L3: inertance Mn of nozzle flow channel in first nozzle region 51*a*
L4: inertance Ms of first ink supply channel 54*a*
R3: resistance Rn of nozzle flow channel in first nozzle region 51*a*
R4: resistance Rs of first ink supply channel 54*a*
C1: compliance Ca of actuator of second pressure chamber 52*b*
C2: compliance Cc of second pressure chamber 52*b*
C5: meniscus compliance Cn of second pressure chamber 52*b*
L1: inertance Mn of nozzle flow channel in second nozzle region 51*b*
L2: inertance Ms of second ink supply channel 54*b*
R1: resistance Rn of nozzle flow channel in second nozzle region 51*b*
R2: resistance Rs of second ink supply channel 54*b*

The control of the deflection of ink droplets ejected by the liquid ejection head according to the present embodiment is described below on the basis of the equivalent circuit shown in FIG. 3.

In the equivalent circuit shown in FIG. 3, the drive waveform e1 is input to the actuator in the form of pressure value. When free vibration starts in the first pressure chamber 52*a* and the second pressure chamber 52*b* because of the drive waveform, the ink flows through the first nozzle region 51*a* and the second nozzle region 51*b*, and these ink flows can be determined as the currents flowing in L1 and L3 in FIG. 3, respectively. In the present embodiment, since the first nozzle region 51*a* and the second nozzle region 51*b* have the same cross-sectional area, then the ratio of the current values corresponds to the ratio of the ink flow speeds in the first nozzle region 51*a* and the second nozzle region 51*b*. Moreover, the current flowing in the section N in FIG. 3 corresponds to the flow speed of the total volume of ink flowing in the first nozzle region 51*a* and the second nozzle region 51*b*.

An object of the present embodiment is to control the direction of ejection of the ink from the nozzle 51, and it is necessary to focus on the ratio of voltages or currents in the equivalent circuit shown in FIG. 3. The values C1 and C3, which correspond to the actuator compliance Ca, are obtained by distributing the total compliance in accordance with the ratio of the surface area of the piezoelectric layer 58 that covers the first pressure chamber 52*a* to the surface area of the piezoelectric layer 58 that covers the second pressure chamber 52*b*. The piezoelectric layer 58 forms a single actuator on the diaphragm 56.

Figure 4:
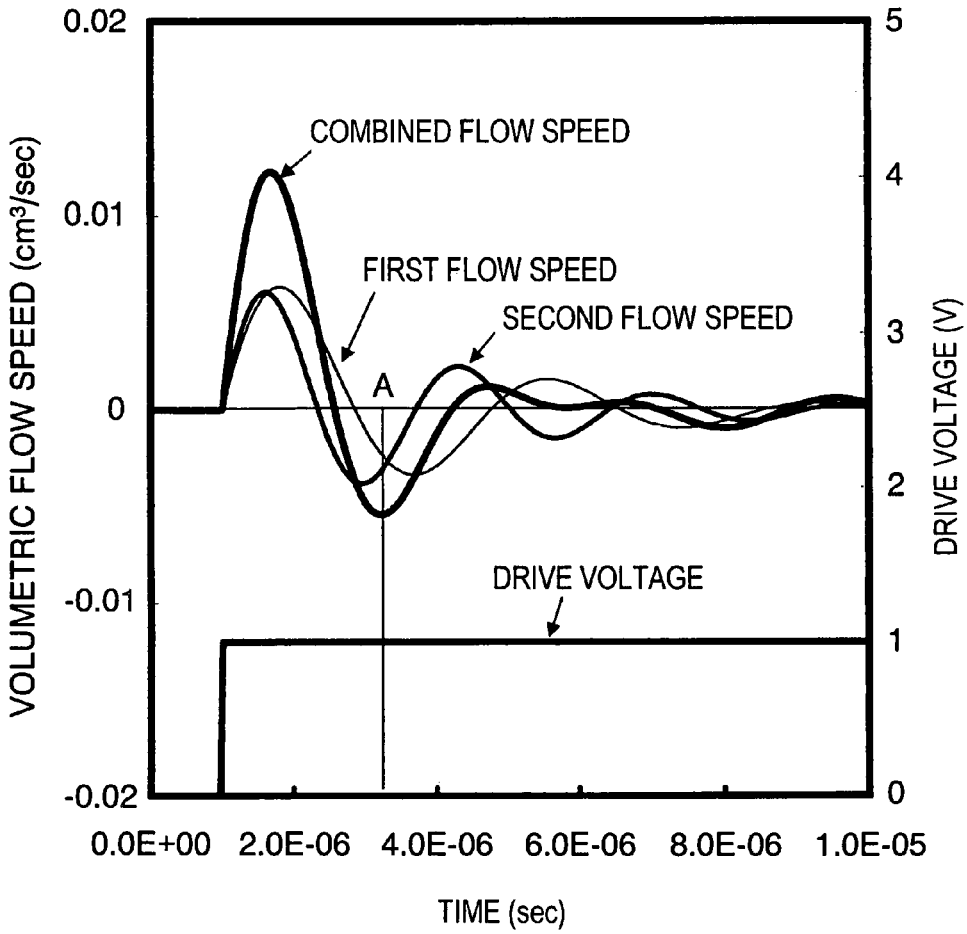
FIG. 4 is a first volumetric flow speed diagram of the liquid ejection head according to the first embodiment.

FIG. 4 is a diagram showing the volumetric flow speed waveforms of the inks in the first nozzle region 51*a* and the second nozzle region 51*b*, and the combined flow speed waveform, on the basis of the equivalent circuit shown in FIG. 3.

More specifically, FIG. 4 shows the volumetric flow speed of the ink in the first nozzle region 51*a* (first flow speed), the volumetric flow speed of the ink in the second nozzle region 51*b* (second flow speed), and the volumetric flow speed of the combined ink of the first nozzle region 51*a* and the second nozzle 51*b* (combined flow speed), in the case where an electric field is applied to the actuator at the time point of $1\times10^{-6}$ (sec). In FIG. 4, when the volumetric flow speed has a negative value, the ink is subjected to an ejection force that ejects the ink from the nozzle 51.

As shown in FIG. 4, by applying a drive waveform so as to apply an electric field at the time point of $1\times10^{-6}$ (sec), the ink present in the nozzle regions 51*a* and 51*b* is pulled firstly toward the pressure chamber side, and then free vibrations are generated in the first pressure chamber 52*a* and the second pressure chamber 52*b* at the respective resonance frequencies. Since the ink has viscosity, these free vibrations are attenuated over time.

Immediately after applying the electric field, once the ink has been pulled firstly toward the pressure chamber side, it then flows conversely in the direction of ink ejection. At the midpoint of this change in the flow speed, the volumetric flow speed becomes zero. At this point, the displacement becomes a maximum, and if a falling wave is applied to the drive waveform (drive voltage) at this time, then the waveforms combine to increase the ink flow speed, and ink can be ejected from the nozzle 51. This is known as "pull-push" driving, which is a system that enables ink to be ejected highly efficiently, by using resonance effects.

Next, the ejection direction of the ink ejected in this way is described below with reference to FIG. 5.

The ejected ink is formed by a combination of the ink flowing from the first nozzle region 51*a* and the ink flowing from the second nozzle region 51*b*. Consequently, the ejection direction of the ink ejected from the nozzle 51 is determined by the combined flow speed vector, which is based on the volumetric flow speed (the first flow speed) vector of the ink flowing from the first nozzle region 51*a* and the volumetric flow speed (the second flow speed) vector of the ink flowing from the second nozzle region 51*b*. Since the combined flow speed becomes a maximum at the point A in FIG. 4, then by making this value of the combined flow speed become equal to or greater than the ink ejection speed, it is possible to eject the ink in the ink ejection direction.

In this way, by controlling the first flow speed and the second flow speed at the time when ink is ejected from the nozzle 51, it is possible to control the ejection direction of the ink ejected from the nozzle 51. If the two flow speed vectors shown in FIG. 5 are substantially parallel, then when the ink ejected from the nozzle assumes a column shape, an asymmetrical flow speed distribution is formed in the column and this causes the column to bend. Moreover, when the column severs and forms an ink droplet, then a rotation is applied to the ink droplet and the flight orbit bends due to air resistance. Even when the two flow speed vectors are not parallel, these effects are also produced, but these effects are small. Therefore, it is desirable for the two flow speed vectors to be non-parallel, as in the present embodiment.

Next, the method of controlling the ink ejection direction in the ink chamber unit illustrated with reference to the equivalent circuit depicted in FIG. 3, is described below. In this method, the ejection direction of the ink from the nozzle 51 is controlled by controlling the pull drive timing and the push drive timing.

Figure 6:
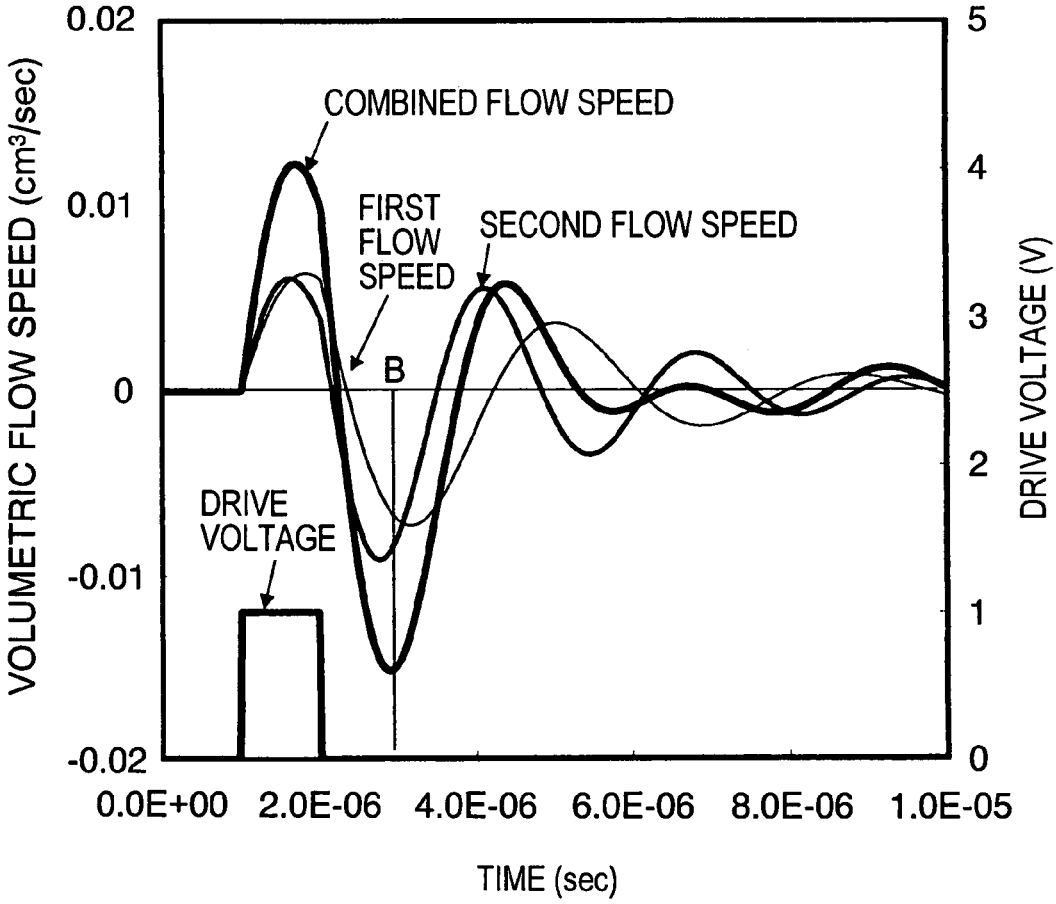
FIG. 6 is a second volumetric flow speed diagram of the liquid ejection head according to the first embodiment.

FIG. 6 shows a case where the pull drive is performed by applying a positive electric field at the time point of $1\times10^{-6}$ (sec) to the piezoelectric element 61 forming the actuator, whereupon the push drive is performed by terminating the application of the positive electric field at the time point of $2\times10^{-6}$ (sec). At the time point B in FIG. 6, the combined flow speed in the liquid ejection direction becomes a maximum and is controlled in such a manner that ink is ejected at this timing. The value of the first flow speed at the time point B is approximately −0.00646 ($cm^3$/sec), the value of the second flow speed is approximately −0.00872 ($cm^3$/sec), and the ratio of the first flow speed to the second flow speed is approximately 1:1.35. Consequently, since the second flow speed is approximately 1.35 times greater than the first flow speed, then the ink ejected from nozzle 51 is more strongly affected by the second flow speed, and the ink can therefore be deflected toward the direction of ejection from the second nozzle region 51*b*. In this case, the magnitude of the combined flow speed is −0.01518 ($cm^3$/sec).

Figure 7:
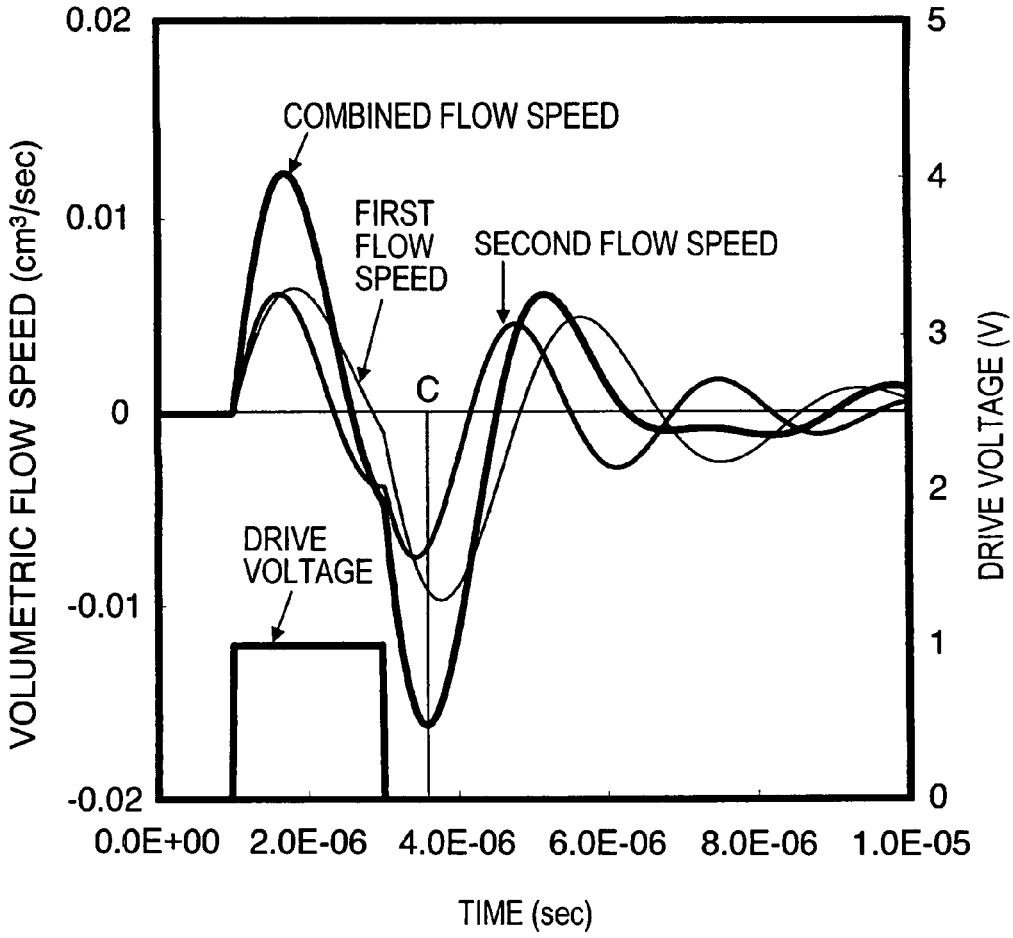
FIG. 7 is a third volumetric flow speed diagram of the liquid ejection head according to the first embodiment.

FIG. 7 shows a case where the pull drive is performed by applying a positive electric field at the time point of $1\times10^{-6}$ (sec) to the piezoelectric element 61 forming the actuator, whereupon the push drive is performed by terminating the application of the positive electric field at the time point of $3\times10^{-6}$ (sec). At the time point C in FIG. 7, the combined flow speed in the liquid ejection direction becomes a maximum and is controlled in such a manner that ink is ejected at this timing. The value of the first flow speed at the time point C is approximately −0.00912 ($cm^3$/sec), the value of the second flow speed is approximately −0.00702 ($cm^3$/sec), and the ratio of the first flow speed to the second flow speed is approximately 1.3:1. Consequently, since the first flow speed is approximately 1.3 times greater than the second flow speed, then the ink ejected from nozzle 51 is more strongly affected by the first flow speed, and the ink can therefore be deflected toward the direction of ejection from the first nozzle region 51*a*. In this case, the magnitude of the combined flow speed is −0.01614 ($cm^3$/sec).

From the above, as shown in FIGS. 6 and 7, by setting the push drive timing to a desired timing, then it is possible to control the angle of deflection of the ink ejected from the nozzle 51.

Figure 5:
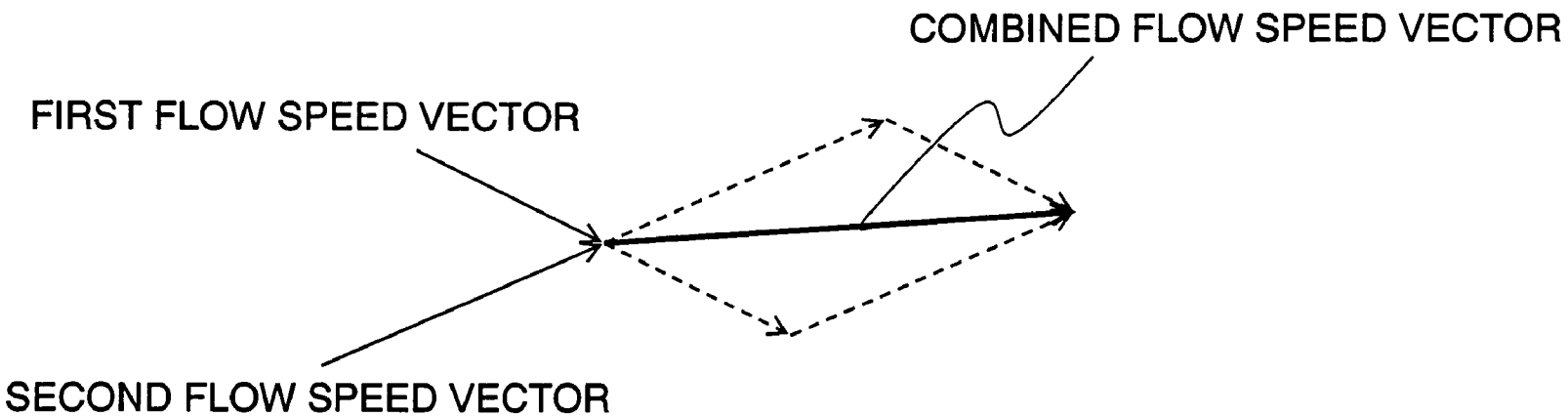
FIG. 5 is an illustrative diagram of deflection control in the liquid ejection head according to the first embodiment.

As shown in FIG. 5, the ink ejected from nozzle 51 is a combination of the ink supplied from the first nozzle region 51*a* and the ink supplied from the second nozzle region 51*b*. If the angle formed between the vector having the flow speed direction of the ink supplied from the first nozzle region 51*a* and the vector having the flow speed direction of the ink supplied from the second nozzle region 51*b* is 30 degrees, then the ejection direction of the ink, which is indicated by the combined vector, can be deflected through approximately 4.42 degrees, by controlling the push driving in the range between the case shown in FIG. 6 and the case shown in FIG. 7. More specifically, if the distance from the surface (nozzle face) of the nozzle 51 in the inkjet head to the recording medium, such as paper, is 1.5 (mm), then the deposition range on the recording medium through which the ink can be controlled by deflection of the ink from the nozzle 51, is approximately 116 (μm). This corresponds to a range of 12 pixels in the case where the image is recorded at a resolution of 2400 (dpi), and ink can be ejected freely within this region, by controlling the push drive timing. In other words, in the present embodiment, it is possible not only to reduce the number of nozzles 51 required for the intended number of pixels, but also to set the resolution freely within a range that can be controlled by pull-push driving, regardless of the number of nozzles 51.

In a case where the angle of deflection is changed, it is necessary for the volume of the ejected ink and the speed of the ejected ink to be kept substantially constant. These values can be kept substantially constant, by setting the drive waveform shown in FIG. 7, namely, the voltage applied to the piezoelectric element 61 forming the actuator, to 94% with respect to the case in FIG. 6.

As mentioned above, it has been described how the ejection direction of the ink from the nozzle 51 is controlled by controlling the push drive in the pull-push driving action. In the description given above, the interval of the pull-push driving is stated to be in the range of 1 (μs) to 2 (μs), but in the present embodiment, it is possible to control the interval of the pull-push driving within a broader range of approximately 0.5 (μs) to 2.7 (μs).

More specifically, in a case where the interval of the pull-push driving is 0.5 (μs), then the pull drive is performed by applying a positive electric field at the time point of $1\times10^{-6}$ (sec) to the piezoelectric element 61 forming the actuator, whereupon the push drive is performed by terminating the application of the positive electric field at the time point of $1.5\times10^{-6}$ (sec). The ejection of ink from the nozzle 51 is controlled in such a manner that the ink is ejected at the timing at which the combined flow speed reaches a maximum, and the ratio of the first flow speed to the second flow speed at the time point when the combined flow speed is the maximum, is approximately 1:1.68. Consequently, the second flow speed is approximately 1.68 times greater than the first flow speed, and hence the ink ejected from the nozzle 51 is more strongly affected by the second flow speed. Accordingly, the angle of deflection of the ink ejected from the nozzle 51 can be increased further toward the direction in which ink is ejected from the second nozzle region 51*b*. Since the magnitude of the combined flow speed in this case is −0.00878 ($cm^3$/sec), then it is necessary to make the voltage applied to the piezoelectric element 61 approximately 1.8 times greater than in the case of FIG. 6. In a case where the interval in the pull-push driving is shortened in this way, since the voltage applied to the piezoelectric element is required to be higher, then the angle of deflection through which the ink ejection direction can be controlled is dependent on the applicable voltage values (voltage range).

On the other hand, in a case where the interval of the pull-push driving is 2.7 (μs), then the pull drive is performed by applying a positive electric field at the time point of $1\times10^{-6}$ (sec) to the piezoelectric element 61 forming the actuator, whereupon the push drive is performed by terminating the application of the positive electric field at the time point of $3.7\times10^{-6}$ (sec). This timing corresponds to the point at which the second flow speed becomes zero and changes from the push direction to the pull direction, as shown in FIG. 4, and if a push drive is applied, then the flow in the ejection direction caused by the push action and the original flow in the pull direction combine together, and the combined second flow speed becomes a minimum. From this time point onwards, the second flow speed increases again, and hence this time point is the condition at which the ratio of the first flow speed to the second flow speed becomes a maximum.

The ratio of the first flow speed to the second flow speed at the point where the combined flow speed becomes a maximum under this condition, is calculated to be approximately 2.0 to 1. Consequently, the first flow speed is approximately 2 times greater than the second flow speed, and the ink ejected from the nozzle 51 is more strongly affected by the first flow speed. Accordingly, the angle of deflection of the ink ejected from the nozzle 51 can be increased further toward the direction in which ink is ejected from the first nozzle region 51*a*. Since the magnitude of the combined flow speed in this case is −0.01168 ($cm^3$/sec), then it is necessary to make the voltage applied to the piezoelectric element 61 approximately 1.3 times greater than in the case of FIG. 6.

By means of the deflection control described above, it is possible to broaden the range of the ink depositing position to approximately 162 (μm), and this corresponds to approximately 16 pixels if the resolution of the formed image is 2400 (dpi). Hence the number of nozzles 51 can be reduced yet further.

In the above-described composition, the angle of deflection of the ink ejected from the nozzle 51 is not symmetrical, but this is not a problem in terms of the printing function, provided that this asymmetry is taken into account when the apparatus is designed. Moreover, it is possible to make the angle of deflection symmetrical by changing the angle of liquid introduction at which the liquid flows into one of the nozzle regions, or other methods.

In the description given above, the ink ejection timing (the timing when the ink droplet is actually ejected from the nozzle 51) is set to the timing at which the combined flow speed becomes a maximum, and therefore, the timing of ink ejection varies depending on the ink ejection direction. However, by adjusting the timing of applying the waveform to the piezoelectric elements 61 forming the actuators, it is possible to maintain the ejection timing constant, regardless of the angle of deflection, and hence the control during image formation is facilitated.

To give a more specific description, the timing (ejection timing) at which the combined flow speed becomes a maximum in the case shown in FIG. 6 is different from the timing in the case shown in FIG. 7, and therefore the position at which ink is deposited on the paper, or other recording medium, is required to be determined in consideration of this deviation of the ejection timing. In other words, since the recording medium, such as paper, is moved relatively to the nozzles 51, then due to the disparity in the ejection timings, the ink depositing position is displaced by the distance corresponding to the conveyance amount of the recording medium, such as paper.

Figure 8:
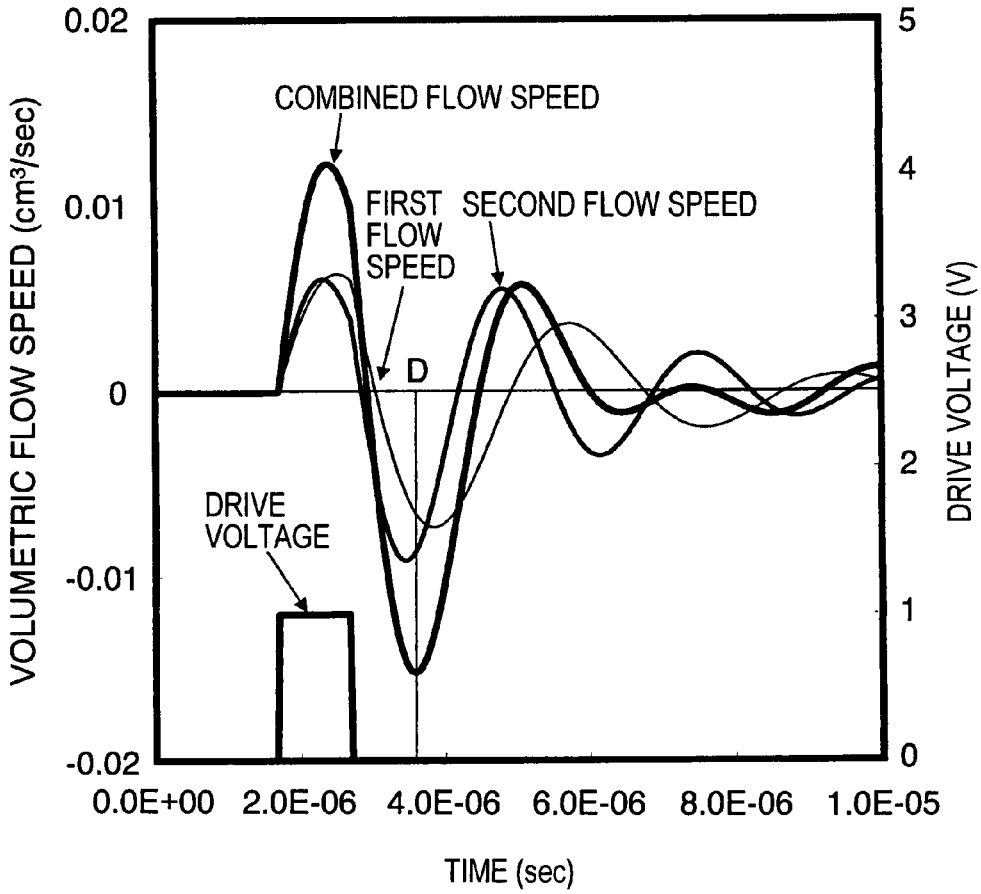
FIG. 8 is a fourth volumetric flow speed diagram of the liquid ejection head according to the first embodiment.

For the purpose of control during image formation, the ejection timing is preferably uniform since this facilitates the control procedure. In the case of FIG. 7, the ink is ejected at the ejection timing later than in the case of FIG. 6, by approximately 0.7 (μs). As shown in FIG. 8, by delaying the whole waveform in the case of FIG. 6, by 0.7 (μs), and applying the resulting waveform to the piezoelectric element 61 forming an actuator, then it is possible to make the ejection timing uniform and to thereby eject the ink at the ejection timing same as in the case of FIG. 7, irrespective of the angle of deflection. Since the ink ejection timing varies depending on the angle of deflection, then it is required for the drive voltage applied to the piezoelectric element 61 forming the actuator to have a waveform which takes this variation into account.

In the inkjet head according to the present embodiment, the characteristics are greatly affected by the surface tension and viscosity of the ink, the structure of the head, and the like, and hence there may be cases where it is necessary to carry out measurement for the inkjet head that has been actually manufactured and to then carry out correction separately. Moreover, when the voltage (drive waveform) applied to the piezoelectric element 61 forming the actuator is adjusted, the speed of the ejected ink also changes accordingly. Consequently, the speed of the ejected ink also changes when the direction of deflection is altered. In this case, desirably, in order to eliminate the displacement of the depositing position due to the speed of the ejected ink, the speed of the ink is adjusted by changing the drive timing after the ink ejection volume is made to be uniform.

As described above, the parameters, such as the ink surface tension, the ink viscosity and the structure of the head, have great effects on the ink ejection characteristics, on the basis of the relationship among the interval of the pull-push driving, the angle of deflection and the print timing, and the relationship between the voltage applied to the actuator and the speed of flight of the ink. Consequently, a desirable composition is one in which a calculation table is prepared in advance and control is implemented by referring to this calculation table.

General Composition of the Inkjet Recording Apparatus

Figure 9:
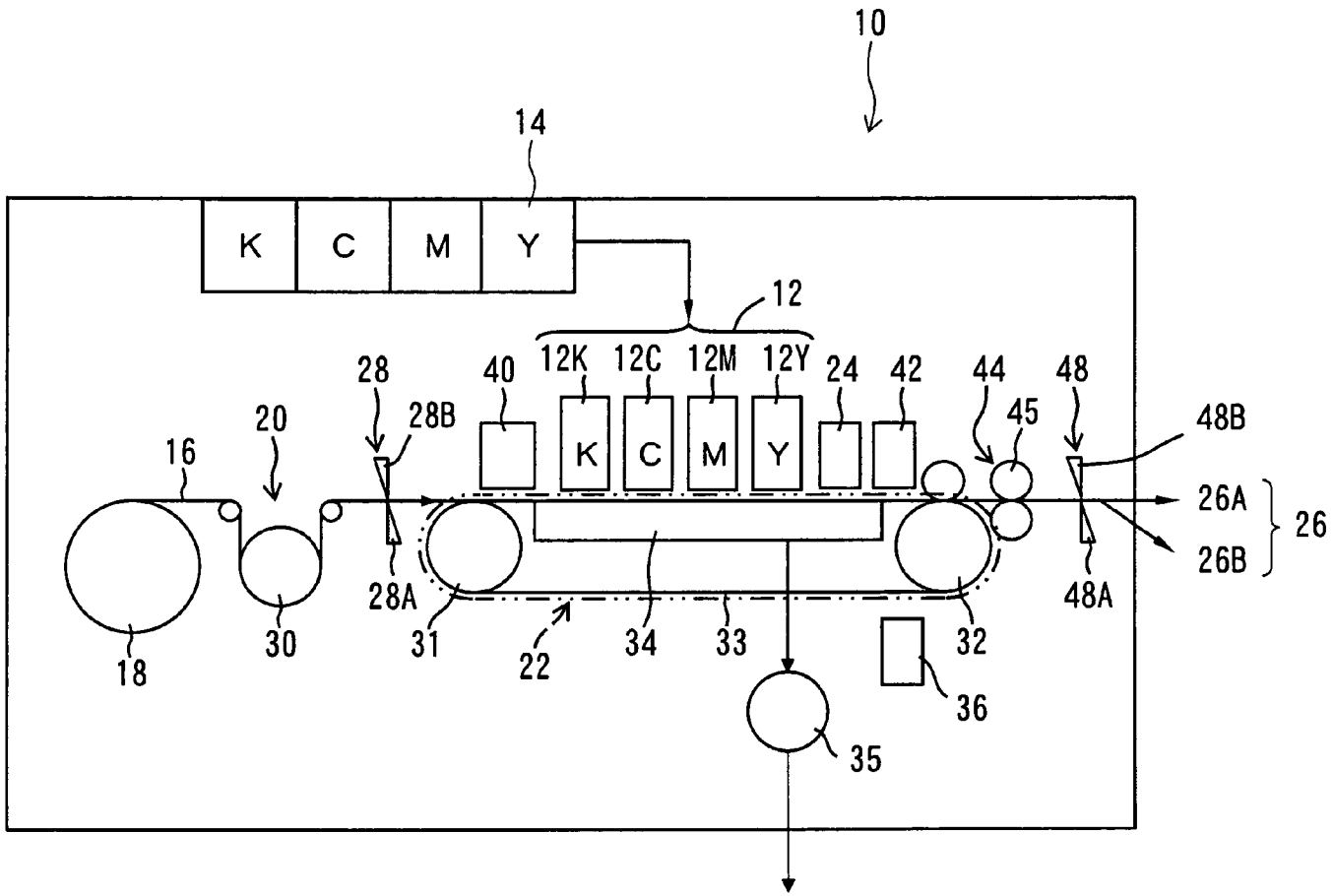
FIG. 9 is a general schematic drawing of an inkjet recording apparatus which is an image forming apparatus according to an embodiment of the present invention.

FIG. 9 is a general schematic drawing showing an inkjet recording apparatus forming an image forming apparatus according to an embodiment of the present invention. As shown in FIG. 9, the inkjet recording apparatus 10 includes: a printing unit 12 having a plurality of liquid ejection heads (hereinafter referred to as "head") 12K, 12C, 12M and 12Y, provided for ink colors of black (K), cyan (C), magenta (M), and yellow (Y), respectively; an ink storing and loading unit 14 for storing inks of K, C, M and Y to be supplied to the heads 12K, 12C, 12M and 12Y; a paper supply unit 18 for supplying recording paper 16; a decurling unit 20 for removing curl in the recording paper 16; a suction belt conveyance unit 22 disposed facing the nozzle faces (ink ejection faces) of the heads 12K, 12C, 12M and 12Y, for conveying the recording paper 16 (recording medium) while keeping the recording paper 16 flat; a print determination unit 24 for reading the printed result produced by the printing unit 12; and a paper output unit 26 for outputting image-printed recording paper (printed matter) to the exterior.

In FIG. 9, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 9, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the heads 12K, 12C, 12M and 12Y and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 9. The suction chamber 34 provides suction with a fan 35 to generate a negative pressure, and the recording paper 16 on the belt 33 is held by suction.

The belt 33 is driven in the clockwise direction in FIG. 9 by the motive force of a motor 88 (not shown in FIG. 9, but shown in FIG. 13) being transmitted to at least one of the rollers 31 and 32, which the belt 33 is set around, and the recording paper 16 held on the belt 33 is conveyed from left to right in FIG. 9.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration of nipping with a brush roller or a water absorbent roller or others, an air blow configuration in which clean air is blown, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can include a roller nip conveyance mechanism, instead of the suction belt conveyance unit 22. However, there is a drawback in the roller nip conveyance mechanism that the print tends to be smeared when the printing area is conveyed by the roller nil) action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 10:
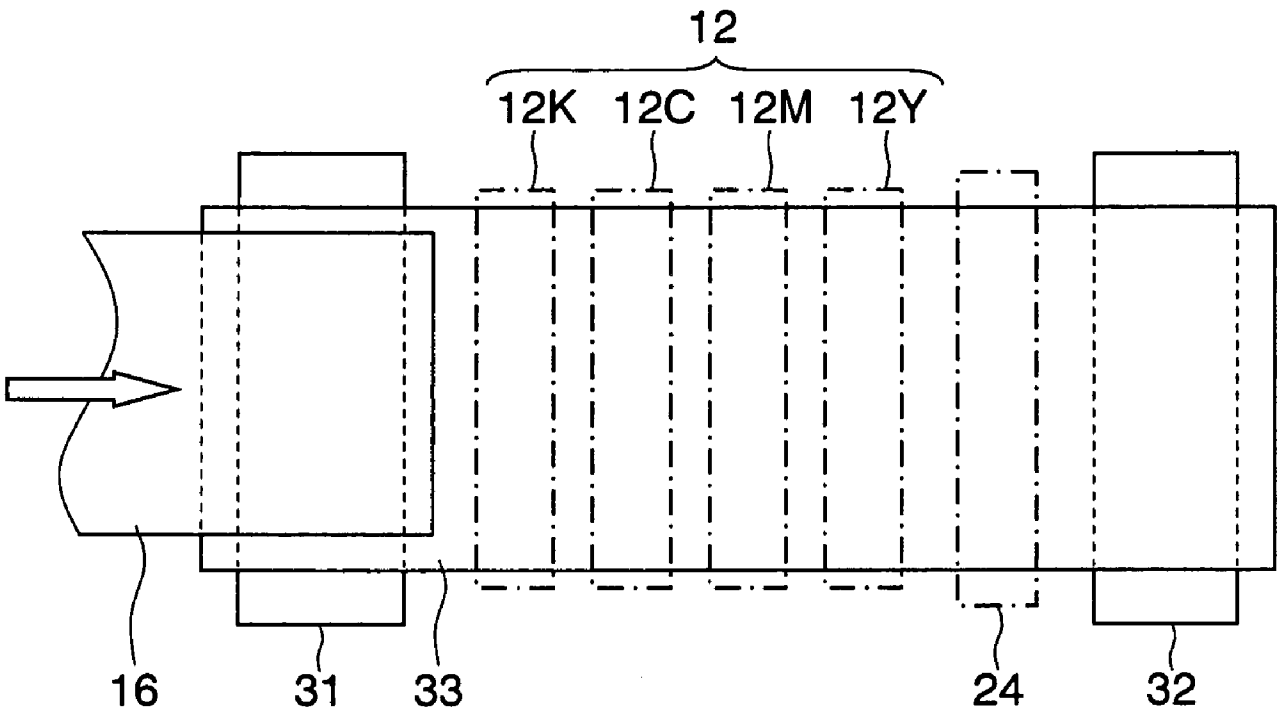
FIG. 10 is a principal plan diagram of the periphery of a print unit in the image forming apparatus.

FIG. 10 is a principal plan diagram showing the periphery of the print unit 12 in the inkjet recording apparatus 10.

As shown in FIG. 10, the print unit 12 has a so-called "full line head" in which a line head having a length corresponding to the maximum paper width is arranged in a direction (main scanning direction) that is perpendicular to the paper feed direction (sub-scanning direction). Each of the heads 12K, 12C, 12M and 12Y constituting the print unit 12 is constituted by a line head, in which a plurality of ink ejection ports (nozzles) are arranged along a length that exceeds at least one side of the maximum-size recording paper 16 intended for use in the inkjet recording apparatus 10.

The heads 12K, 12C, 12M and 12Y are arranged in the order of black (K), cyan (C), magenta (M), and yellow (Y) from the upstream side (on the left-hand side in FIG. 9), along the feed direction of the recording paper 16. A color image can be formed on the recording paper 16 by ejecting the inks from the heads 12K, 12C, 12M and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction just once (in other words, by means of a single sub-scan). Higher-speed printing is thereby made possible and productivity can be improved in comparison with a shuttle type head configuration in which a head moves reciprocally in the main scanning direction that is perpendicular to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added.

As shown in FIG. 9, the ink storing and loading unit 14 has ink tanks for storing the inks of the colors corresponding to the respective heads 12K, 12C, 12M and 12Y, and the respective tanks are connected to the heads 12K, 12C, 12M and 12Y by means of channels (not shown). The ink storing and loading unit 14 has a warning device (for example, a display device, an alarm sound generator or the like) for warning when the remaining amount of any ink is low, and has a mechanism for preventing loading errors among the colors.

The print determination unit 24 has an image sensor (line sensor or the like) for capturing an image of the ink-droplet deposition result of the printing unit 12, and functions as a device to check for ejection defects such as clogs of the nozzles from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in drawings, the paper output unit 26A for the target prints is provided with a sorter for collecting prints according to print orders.

Configuration of Liquid Ejection Head

Next, the structure of a head will be described. The heads 12K, 12C, 12M and 12Y of the respective ink colors have the same structure, and a reference numeral 50 is hereinafter designated to any of the heads.

Figure 11A:
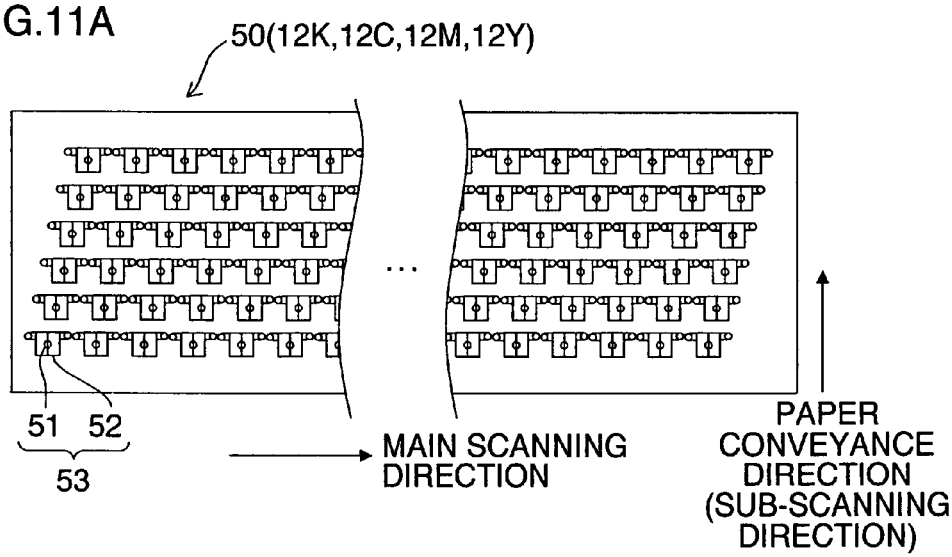
FIGS. 11A to 11C are plan view perspective diagrams showing examples of the composition of the liquid ejection head.
Figure 11B:
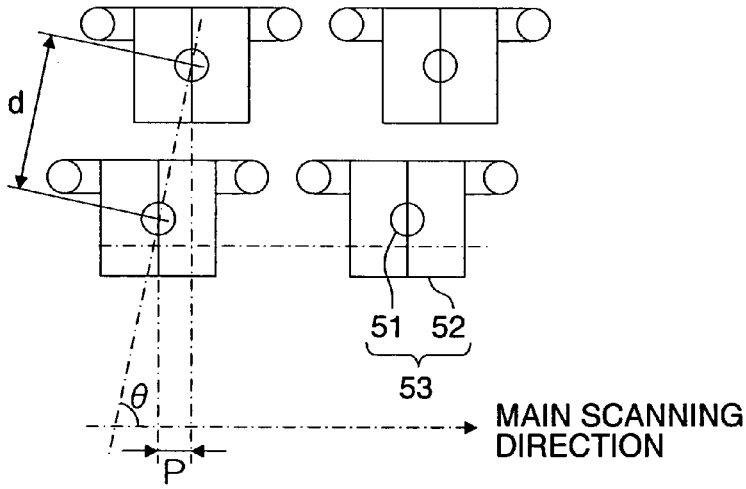
Figure 11C:
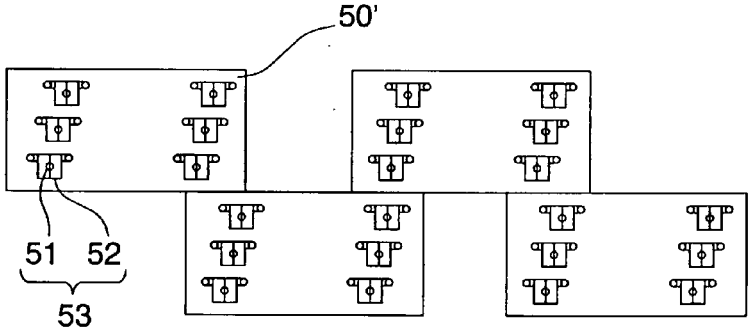

FIG. 11A is a perspective plan view showing an embodiment of the configuration of the head 50, FIG. 11B is an enlarged view of a portion thereof, FIG. 11C is a perspective plan view showing another embodiment of the configuration of the head 50.

The nozzle pitch in the head 50 should be minimized in order to maximize the resolution of the dots printed on the surface of the recording paper 16. As shown in FIGS. 11A to 11C, the head 50 according to the present embodiment has a structure in which a plurality of ink chamber units 53, each having a nozzle 51 forming an ink droplet ejection port, a pressure chamber (liquid chamber) 52, and a supply port 54 corresponding to the nozzle 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved. In the present embodiment, the high density of pixels can be further enhanced by controlling the ejection direction.

The mode of forming one or more nozzle rows through a length corresponding to the entire width of the recording paper 16 in the main scanning direction substantially perpendicular to the conveyance direction is not limited to the embodiment described above. For example, instead of the configuration in FIG. 11A, as shown in FIG. 11C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

The present embodiment describes a mode in which the planar shape of the pressure chambers 52 is substantially a square shape, but the planar shape of the pressure chambers 52 is not limited to being a substantially square shape, and it is possible to adopt various other shapes, such as a substantially circular shape, a substantially elliptical shape, a substantially parallelogram (or rhombus) shape, or the like. Furthermore, the arrangement of the nozzles 51 and the supply ports 54 is not limited to the arrangement shown in FIGS. 11A to 11C, and it is also possible to arrange nozzles 51 substantially in the side region of the pressure chambers 52.

As shown in FIG. 11B, the high-density nozzle head according to the present embodiment is achieved by arranging a plurality of ink chamber units 53 in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 300 nozzles per inch, for example. In the present embodiment, the flight direction of the ink droplets can be deflected by up to 16 pixels in the main scanning direction, and the flight direction is actually deflected by 8 pixels, resulting in the dot resolution of 300×8=2400 dpi. The deflection corresponding to the surplus 8 pixels are used to compensate for the adjacent nozzles with abnormalities. Moreover, it is also possible to suppress the image non-uniformity due to variations of characteristics between nozzles by deflecting the flight direction and forming the dot across the adjacent nozzle.

When implementing the present invention, the arrangement structure of the nozzles is not limited to the embodiment shown in the drawings, and it is also possible to apply various other types of nozzle arrangements, such as an arrangement structure having one nozzle row in the sub-scanning direction, a structure having nozzle rows arranged in a two-row staggered configuration, and the like.

In a full-line head including rows of nozzles that have a length corresponding to the entire width of the image recordable width, the "main scanning" is defined as printing one line (a line formed of a row of dots, or a line formed of a plurality of rows of dots) in the width direction of the recording medium (the main scanning direction) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIGS. 11A to 11C are driven, the main scanning according to the above-described (3) is preferred.

On the other hand, "sub-scanning" is defined as to repeatedly perform printing of one line (a line formed of a row of dots, or a line formed of a plurality of rows of dots) formed by the main scanning, while moving the full-line head and the recording paper 16 relatively to each other.

In the present embodiment, a full line head is described, but the scope of application of the present invention is not limited to this and it can also be applied to a serial type of head which carries out printing in the breadthways direction of the recording paper 16 while scanning a short head having nozzle rows of a length shorter than the width of the recording paper 16, in the breadthways direction of the recording paper 16.

As shown in FIGS. 11A to 11C, the pressure chamber 52 provided corresponding to each of the nozzles 51 is approximately square-shaped in plan view, and a nozzle 51 and a supply port 54 are formed respectively at either corner of a diagonal of the pressure chamber 52. The pressure chambers 52 are connected to a common flow channel (common liquid chamber), which is not illustrated, through the supply ports shown in FIGS. 11A and 11B. The common flow channel is connected to an ink supply tank which is not shown in the drawings, and the ink supplied from the ink supply tank is distributed and supplied to the respective pressure chambers 52 through the common flow channel.

Ejection Recovery Unit

Figure 12:
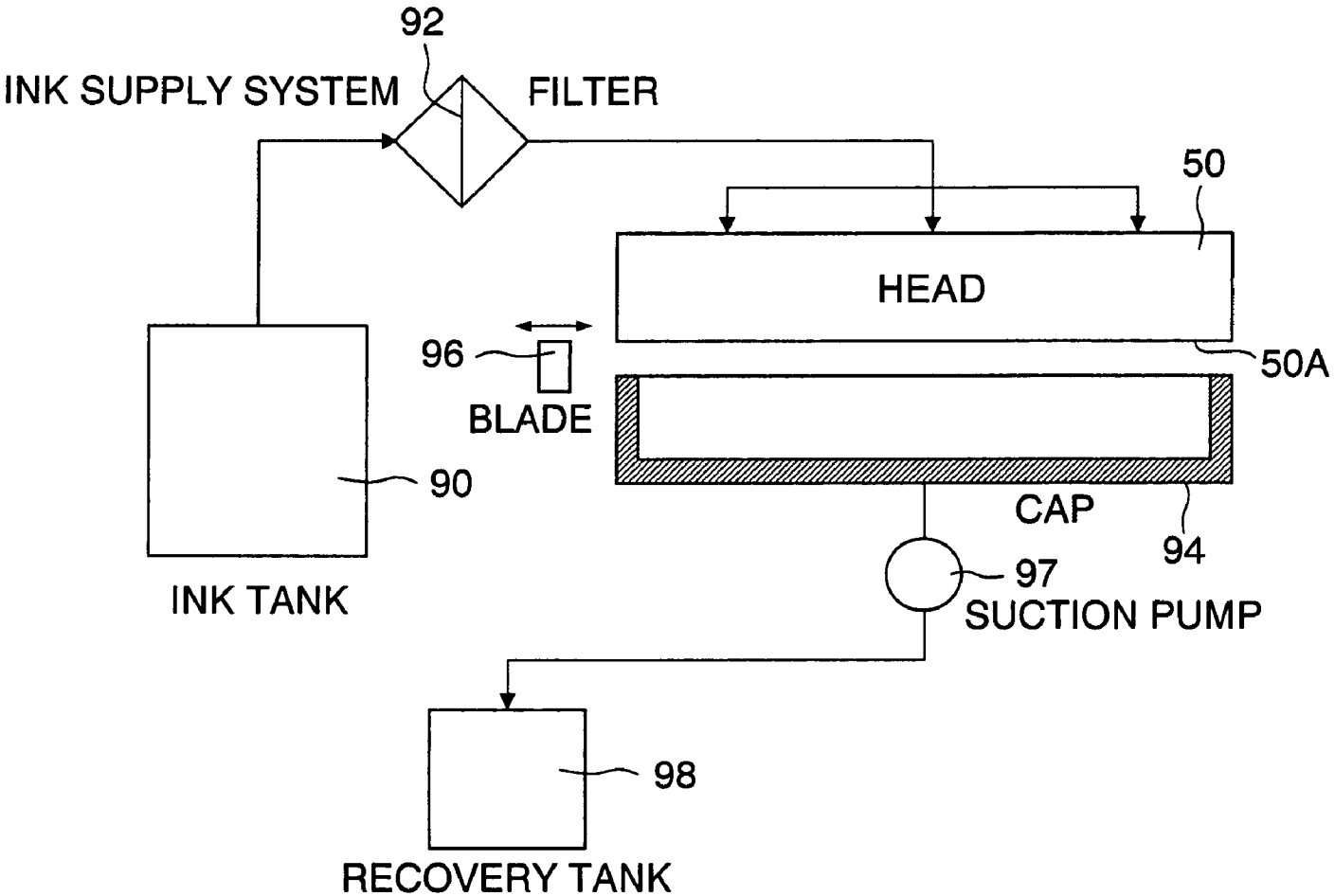
FIG. 12 is a schematic drawing showing an approximate view of an ink supply system in the liquid ejection head.

FIG. 12 is a schematic drawing showing the configuration of the ink supply system in the inkjet recording apparatus 10. The ink tank 90 is a base tank that supplies ink to the print head 50 and is set in the ink storing and loading unit 14 described with reference to FIG. 9. The aspects of the ink tank 90 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 90 in FIG. 12 is equivalent to the ink storing and loading unit 14 in FIG. 9 described above.

A filter 92 for removing foreign matters and bubbles is disposed in a pipe line that connects the ink tank 90 to the print head 50 as shown in FIG. 12. The filter mesh size is preferably equivalent to or less than the diameter of the nozzle of the print head 50 and commonly about 20 μm.

Although not shown in FIG. 12, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 94 as a device to prevent the nozzles from drying out or to prevent an increase in the ink viscosity in the vicinity of the nozzles 51, and a cleaning blade 96 as a device to clean the nozzle face 50A.

A maintenance unit including the cap 94 and the cleaning blade 96 can be relatively moved with respect to the print head 50 by a movement mechanism (not shown), and is moved from a predetermined holding position to a maintenance position below the print head 50 as required.

The cap 94 is displaced upward and downward in a relative fashion with respect to the print head 50 by an elevator mechanism (not shown). When the power of the inkjet recording apparatus 10 is switched off or when the apparatus is in a standby state for printing, the elevator mechanism raises the cap 94 to a predetermined elevated position so as to make tight contact with the print head 50, and the nozzle region of the nozzle face 50A is thereby covered by the cap 94.

The cleaning blade 96 is composed of rubber or another elastic member, and can slide on the ink ejection surface (nozzle face 50A) of the print head 50 by means of a blade movement mechanism (not shown). If there are ink droplets or foreign matter adhering to the nozzle face 50A, then the nozzle face 50A is wiped by causing the cleaning blade 96 to slide over the nozzle face 50A, thereby cleaning same.

During printing or during standby, if the use frequency of a particular nozzle 51 has declined and the ink viscosity in the vicinity of the nozzle 51 has increased, then a preliminary ejection is performed toward the cap 94, in order to remove the ink that has degraded as a result of increasing in viscosity.

In other words, when a state in which ink is not ejected from the print head 50 continues for a certain amount of time or longer, the ink solvent in the vicinity of the nozzles evaporates and ink viscosity increases. In such a state, ink can no longer be ejected from the nozzle 51 even when an actuator (the piezoelectric element 58) for the ejection driving is operated. Before reaching such a state (in a viscosity range that allows ejection by the operation of the piezoelectric element 58) the piezoelectric element 58 is operated to perform the preliminary discharge to eject the ink whose viscosity has increased in the vicinity of the nozzle toward the ink receptor. After the nozzle face 50A is cleaned by a wiper such as the cleaning blade 96 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

Moreover, when bubbles have become intermixed into the ink inside the print head 50 (the ink inside the pressure chambers 52), the cap 94 is placed on the print head 50, ink (ink in which bubbles have become intermixed) inside the pressure chambers 52 is removed by suction with a suction pump 97, and the ink removed by suction is sent to a recovery tank 98. This suction operation is also carried out in order to suction and remove degraded ink which has hardened due to increasing in viscosity when ink is loaded into the print head for the first time, and when the print head starts to be used after having been out of use for a long period of time.

More specifically, when bubbles have become intermixed into a nozzle 51 or a pressure chamber 52, or when the ink viscosity inside the nozzle 51 has increased over a certain level, ink can no longer be ejected from the nozzle 51 by means of a preliminary ejection by operating the piezoelectric element 58. In a case of this kind, a cap 94 is placed on the nozzle face 50A of the print head 50, and the ink containing air bubbles or the ink of increased viscosity inside the pressure chambers 52 is suctioned by a pump 97.

However, since this suction action is performed with respect to all the ink in the pressure chambers 52, then the amount of ink consumption is considerable. Therefore, a preferred aspect is one in which a preliminary discharge is performed when the increase in the viscosity of the ink is small. Furthermore, the cap 94 described in FIG. 12 not only functions as a suction device by also functions as an ink receiver for preliminary ink ejection.

Moreover, desirably, the inside of the cap 94 is divided by means of partitions into a plurality of areas corresponding to the nozzle rows, thereby achieving a composition in which suction can be performed selectively in each of the demarcated areas, by means of a selector, or the like.

Description of Control System

Figure 13:
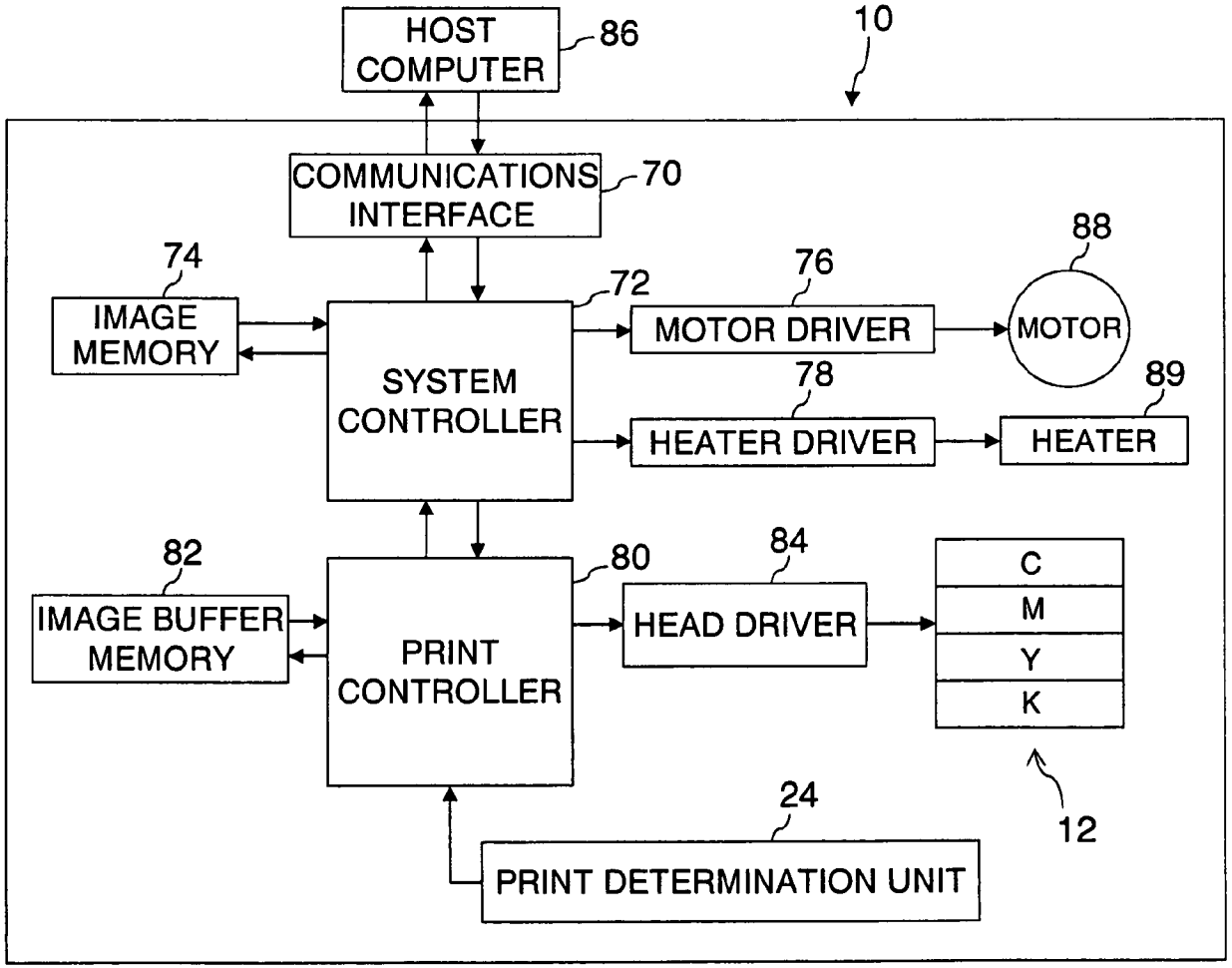
FIG. 13 is a principal block diagram showing an example of the system configuration of the image forming apparatus according to an embodiment of the present invention.

FIG. 13 is a principal block diagram showing the system configuration of the inkjet recording apparatus 10. The inkjet recording apparatus 10 includes a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB (universal serial bus), IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74. The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is a control unit for controlling the various sections, such as the communications interface 70, the memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the memory 74, or the like, it also generates a control signal for controlling the motor 88 of the conveyance system and the heater 89.

The motor driver (drive circuit) 76 drives the motor 88 in accordance with commands from the system controller 72. The heater driver 78 drives the heater 89 of the post-drying unit 42 (shown in FIG. 9) or the like in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print control signal to the head driver 84. Prescribed signal processing is carried out in the print controller 80, and the ejection amount and the ejection timing of the ink droplets from the respective print heads 12 are controlled (droplet ejection control) through the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 13 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 drives the piezoelectric elements 58 of the heads of the respective colors 12K, 12C, 12M and 12Y on the basis of print data supplied by the print controller 80. The head driver 84 can be provided with a feedback control system for maintaining constant drive conditions for the print heads. In the present embodiment, control circuits for controlling the ejection direction are incorporated into the head driver 84.

The print determination unit 24 is a block that includes the line sensor as described above with reference to FIG. 9, reads the image printed on the recording paper 16, determines the print conditions (presence of the ejection, variation in the dot formation, and the like) by performing desired signal processing, or the like, and provides the determination results of the print conditions to the print controller 80. According to requirements, the print controller 80 makes various corrections with respect to the head 50 on the basis of information obtained from the print determination unit 24.

The system controller 72 and the print controller 80 may be constituted by one processor, and it is also possible to use a device which combines a system controller 72, a motor driver 76, and a heater driver 78, in a single device, or a device which combines a print controller 80 and a head driver in a single device.

Second Embodiment

Figure 14A:
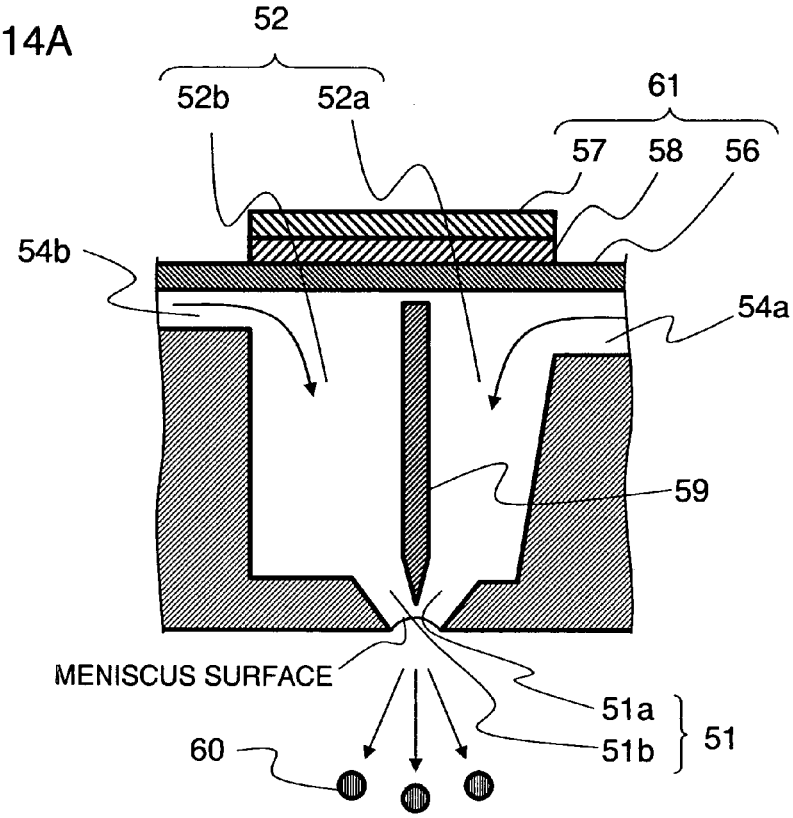
FIGS. 14A and 14B are cross-sectional diagrams of a liquid ejection head according to a second embodiment of the present invention.

In a second embodiment, as shown in FIG. 14A, the partition wall 59 which separates the first nozzle region 51*a* from the second nozzle region 51*b* is provided at a position that is withdrawn from the liquid ejection surface (nozzle face) of the nozzle 51 (in other words, the tip of the partition wall 59 is situated at the position that is withdrawn from the liquid ejection surface of the nozzle 51. In the second embodiment, a composition is adopted in which the first nozzle region 51*a* and the second nozzle region 51*b* are not separated completely, and a nozzle flow channel is formed inside the nozzle 51 through which ink can flow between the first nozzle region 51*a* and the second nozzle region 51*b*.

Figure 14B:
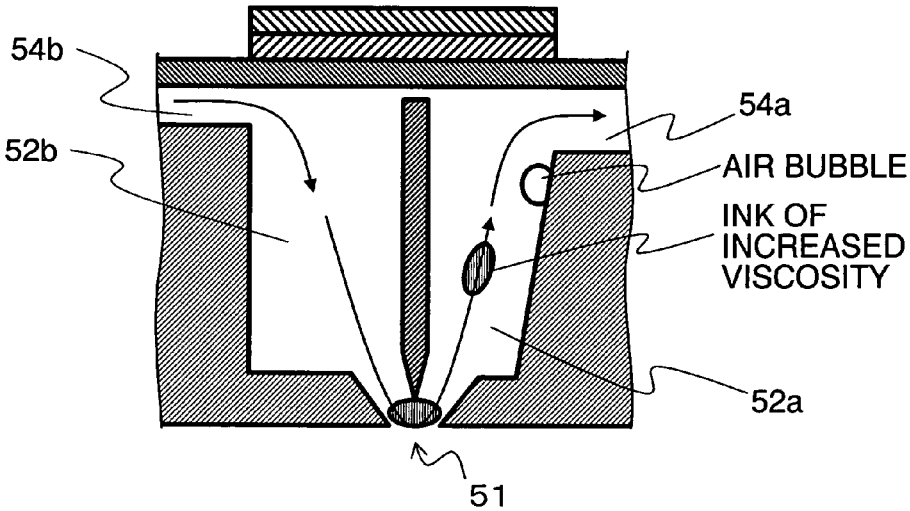

By adopting a composition of this kind, as shown in FIG. 14B, it is possible to make the ink flow through the nozzle flow channel formed by the first nozzle region 51*a* and the second nozzle region 51*b*, from one pressure chamber (for example, the second pressure chamber 52*b*) into the other pressure chamber (for example, the first pressure chamber 52*a*). Therefore, it is possible to prevent ejection errors due to the increase in the viscosity of the ink caused by evaporation of the ink solvent in the region of the nozzle 51. In other words, if the ink continues in a non-ejected state, then the solvent continuously evaporates from the nozzle 51, and the solvent concentration of the ink in the vicinity of the nozzle 51 declines, thereby causing the ink viscosity to increase, which may in turn make it difficult to eject ink. However, in the liquid ejection head according to the present embodiment, the ink is caused to flow through the nozzle flow channel at the nozzle 51; therefore, it is possible to prevent increase in the ink viscosity and thus prevent ink ejection errors, and to reduce the number of ink ejection error restoration operations described above and therefore improve through-put.

The volume of the ink flowing through the nozzle flow channel is dependent on the humidity conditions of the environment surrounding the liquid ejection head. According to experimental results obtained by the inventor, the ratio of the ink flow volume to the maximum ejection volume of the liquid ejection head ranges approximately 1/10 through 1/100, in other words, from several ten through several hundred picolitters per second (pl/sec) for one nozzle. Ink of an ink supply volume which compensates for the ink ejection volume (for example, 80000 pl/sec of ink if 2 pl of ink is ejected at 40 kHz) is required to flow from the ink supply channel to the pressure chamber, whereas compared to this value, the ink flowing in the nozzle flow channel is extremely small and a very slow flow is sufficient. Therefore, it is possible to make the nozzle flow channel narrow, as in the present embodiment.

The ink flowing through the nozzle flow channel is circulated, and the first ink supply channel 54*a* connected to the first pressure chamber 52*a* and the second ink supply channel 54*b* connected to the second pressure chamber 52*b* are connected to the common liquid chamber (not illustrated), and back pressures in the ink supply channels 54*a* and 54*b* are set to mutually different values. The ink is caused to circulate due to this differential between the back pressures. The back pressures are set to approximately 20 to 100 ($mmH_2O$), for example, to approximately 40 ($mmH_2O$), and from experience, it is known that the pressure differential of approximately several $mmH_2O$ is sufficient.

Desirably, the shape of the nozzle hole according to the present embodiment is an elliptical shape or a rhombus shape which is broadened in the direction where the first nozzle region 51*a* and the second nozzle region 51*b* are aligned, rather than a circular shape. This is because a shape of this kind makes it easier to control the deflection. Since the ink flows in this way, then the ink surrounding air bubbles shown in FIG. 14B are successively replaced with fresh one because of the flow of ink, and therefore the air bubbles become more liable to dissolve into the ink, which is effective in terms of preventing ejection errors caused by air bubbles.

Third Embodiment

Figure 15:
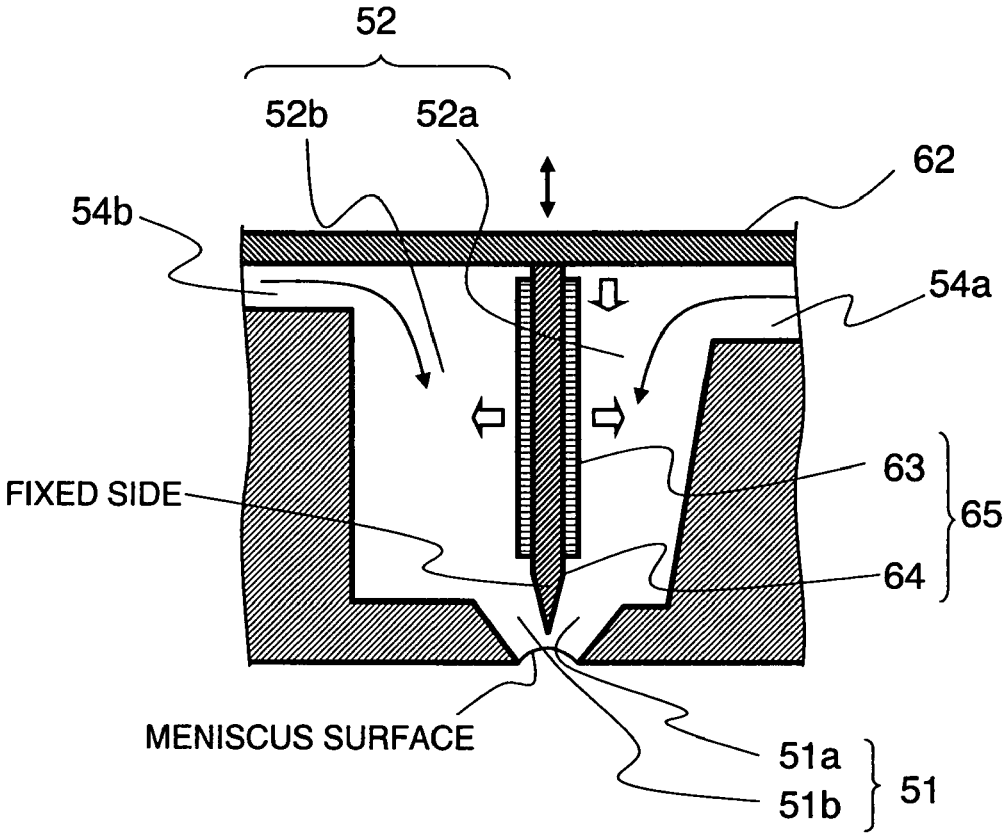
FIG. 15 is a cross-sectional diagram of a liquid ejection head according to a third embodiment of the present invention.

The third embodiment is a composition in which the partition is formed by a piezoelectric element 65 which constitutes an actuator (see FIG. 15). The piezoelectric element 65 is constituted by a piezoelectric layer 64 of PZT (lead zirconate titanate) and electrodes 63, and when an electric field is applied to the piezoelectric element 65, the piezoelectric layer 64 extends and contracts in the thickness direction of the piezoelectric layer 64, and hence a pressure can be applied simultaneously to the pressure chambers 52*a* and 52*b*.

Thereby, similarly to the case of the first embodiment, it is possible to control the ejection direction of the ink ejected from the nozzle 51 by means of one actuator (common actuator). When the piezoelectric layer 64 extends or contracts in the thickness direction, it also performs a deformation in the lengthwise direction in such a manner that the volume remains constant.

As shown in FIG. 15, an end of the piezoelectric layer 64 in the partition is fixed to opposing walls of the pressure chamber that are parallel to the cross-section of the pressure chamber shown in FIG. 15, on the side adjacent to the nozzle 51, while the other end is fixed to a displaceable pressure chamber wall 62. Accordingly, when the piezoelectric layer 64 extends in the thickness direction, it contracts in the lengthwise direction, and hence the pressure chamber wall 62 fixed to the piezoelectric layer 64 is pulled toward the ink side. All of the deformations in these directions reduce the volumes of the pressure chambers 52*a* and 52*b*, and hence apply pressure to the ink.

Figure 16:
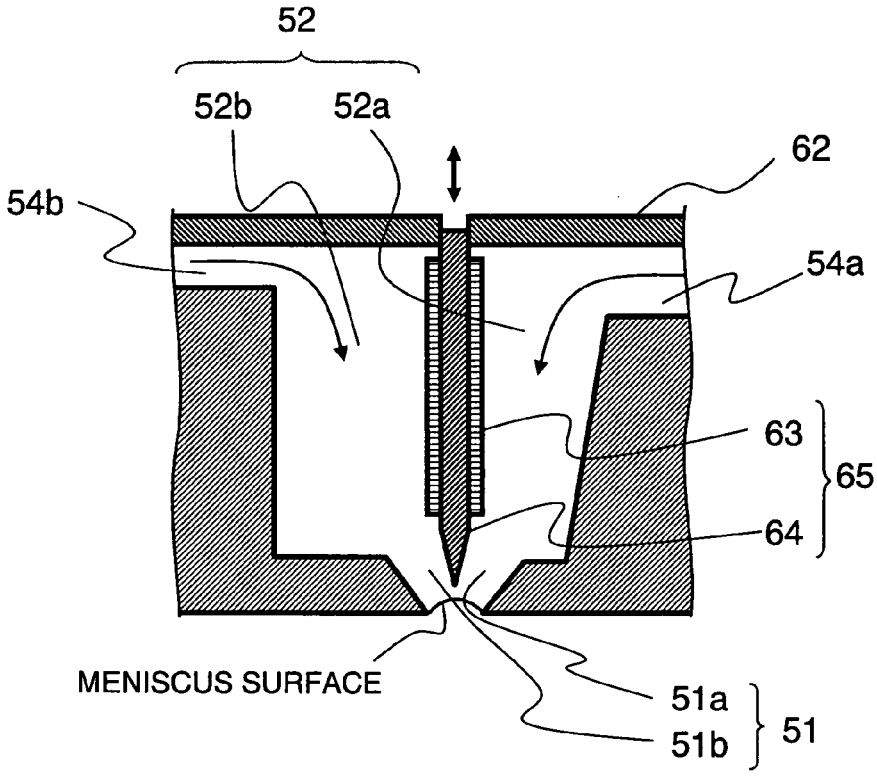
FIG. 16 is a cross-sectional diagram of another composition of a liquid ejection head according to the third embodiment of the present invention.

As shown in FIG. 16, another composition may be adopted in which the piezoelectric layer 64 is fixed on the nozzle 51 side, and the piezoelectric layer 64 is arranged in contact with the pressure chamber wall 62 on the other side, in such a manner that the effect of the shape change in the piezoelectric layer 64 in the lengthwise direction is not transmitted. Accordingly, the change in the piezoelectric layer 64 in the lengthwise direction does not affect the pressure chambers 52*a* and 52*b*, and a volume change is applied to the pressure chambers 52*a* and 52*b* in accordance with only the change which occurs in the piezoelectric layer 64 in the thickness direction. In the contact portion between the pressure chamber wall 62 and the piezoelectric layer 64, a gap may be provided to the extent that the ink is prevented from flowing into the gap because of the high viscosity resistance and the piezoelectric layer 64 is movable by a minute distance.

Figure 17:
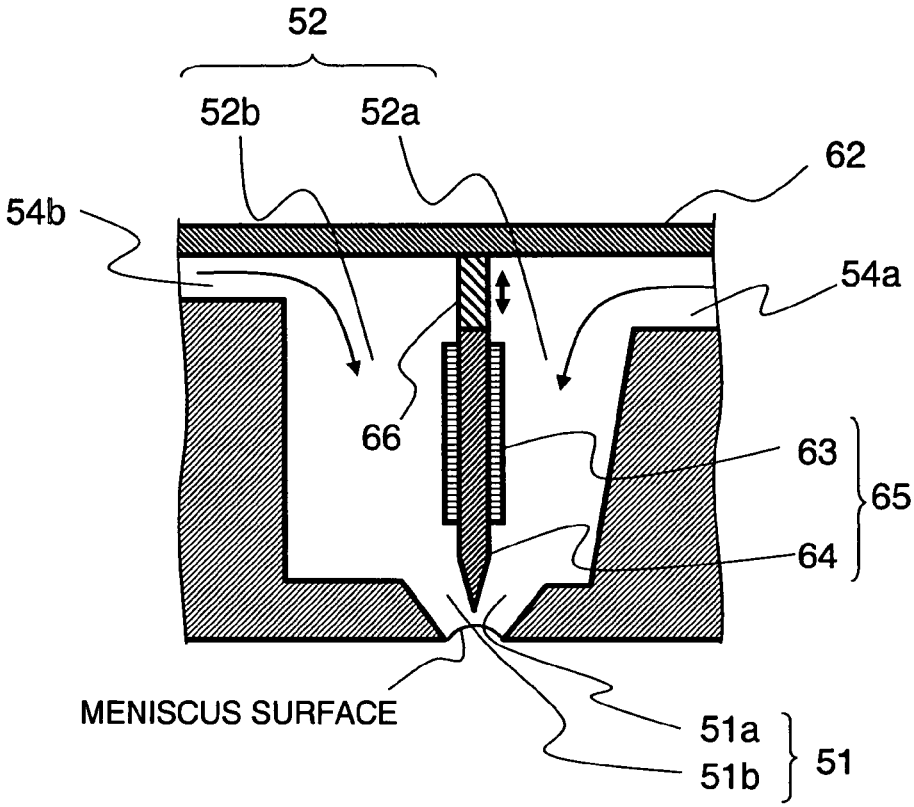
FIG. 17 is a cross-sectional diagram of another composition of the liquid ejection head according to the third embodiment.

Moreover, as shown in FIG. 17, a further composition may be adopted in which the piezoelectric layer 64 is fixed on the nozzle 51 side, and an elastic body 66 made of rubber, or the like, is provided between the piezoelectric layer 64 and the pressure chamber wall 62 on the other side. It is desirable that this elastic body 66 have anisotropic elastic properties whereby the elastic body 66 does not change in the thickness direction even when the elastic body 66 has changed in the lengthwise direction. By adopting a composition of this kind, the change in the lengthwise direction of the piezoelectric layer 64 does not affect the volumes of the pressure chambers 52*a* and 52*b*, and only the change in the thickness direction of the piezoelectric layer 64 affects the volumes of the pressure chambers 52*a* and 52*b*.

Fourth Embodiment

Figure 18:
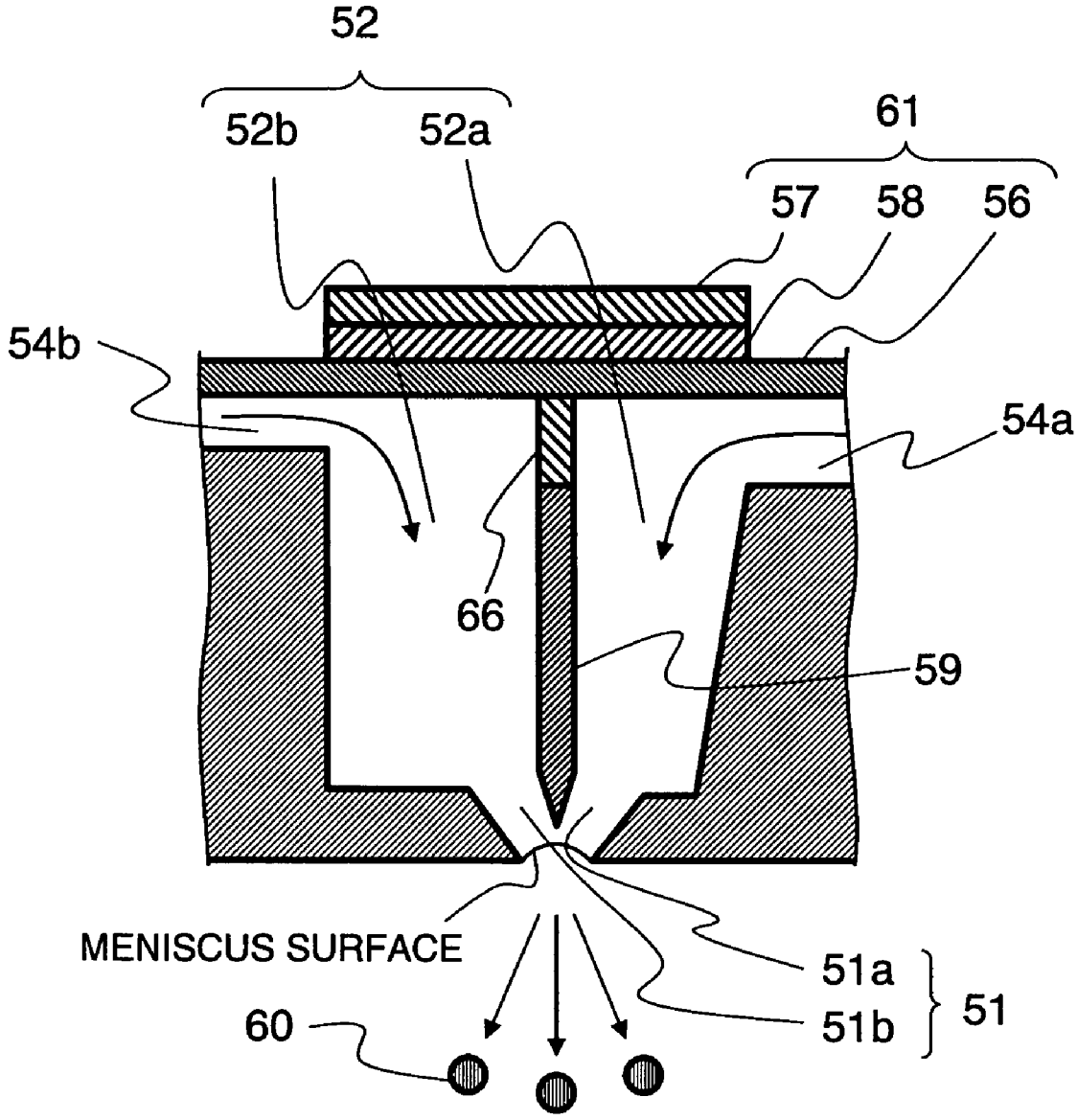
FIG. 18 is a cross-sectional diagram of a liquid ejection head according to a fourth embodiment of the present invention.

As shown in FIG. 18, in a fourth embodiment, an elastic body 66 is provided between the partition 59 and the diaphragm 56, and the ink is completely prevented from flowing into a space between the partition 59 and the diaphragm 56. By adopting a composition of this kind, then loss of the vibration generated by the piezoelectric element 61 can be prevented yet further.

Figure 19A:
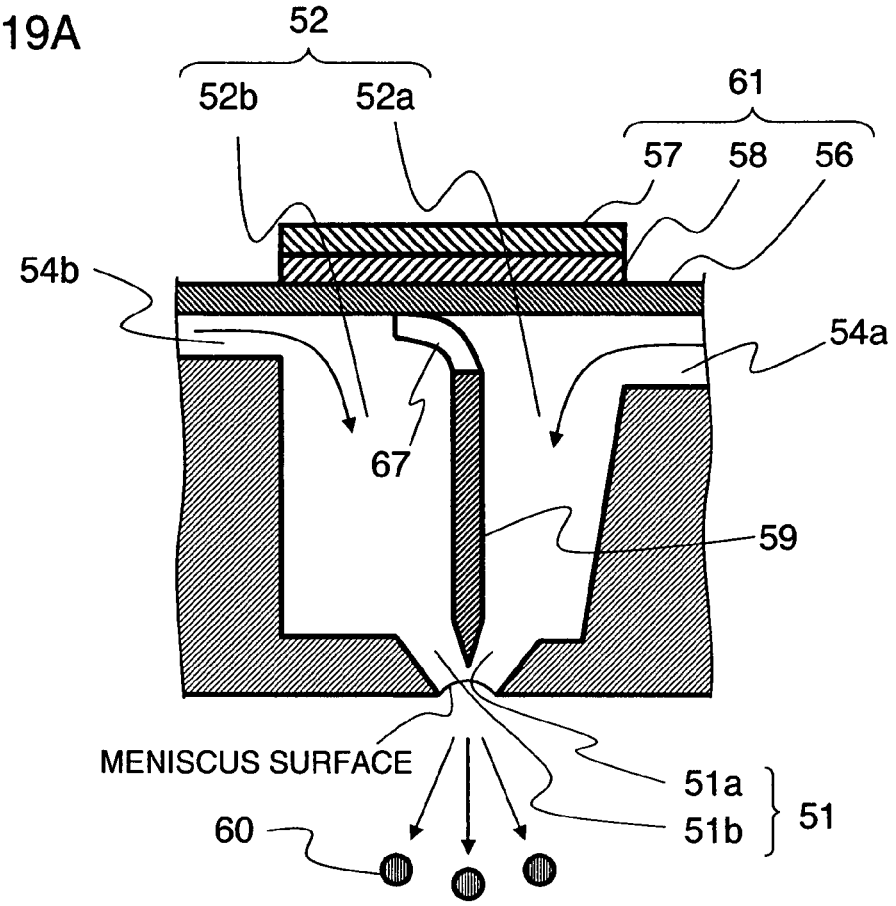
FIGS. 19A and 19B are cross-sectional diagrams of another composition of the liquid ejection head according to the fourth embodiment.

Moreover, as shown in FIG. 19A, a portion of the partition 59 that makes contact with the diaphragm 56 may be composed of a bendable member 67 made of a material having elastic properties, or the like.

Since the amount of displacement of the diaphragm 56 is approximately 1 μm at a maximum, then even in the case of the composition described above, the displacement of the diaphragm 56 is never impeded.

Figure 19B:
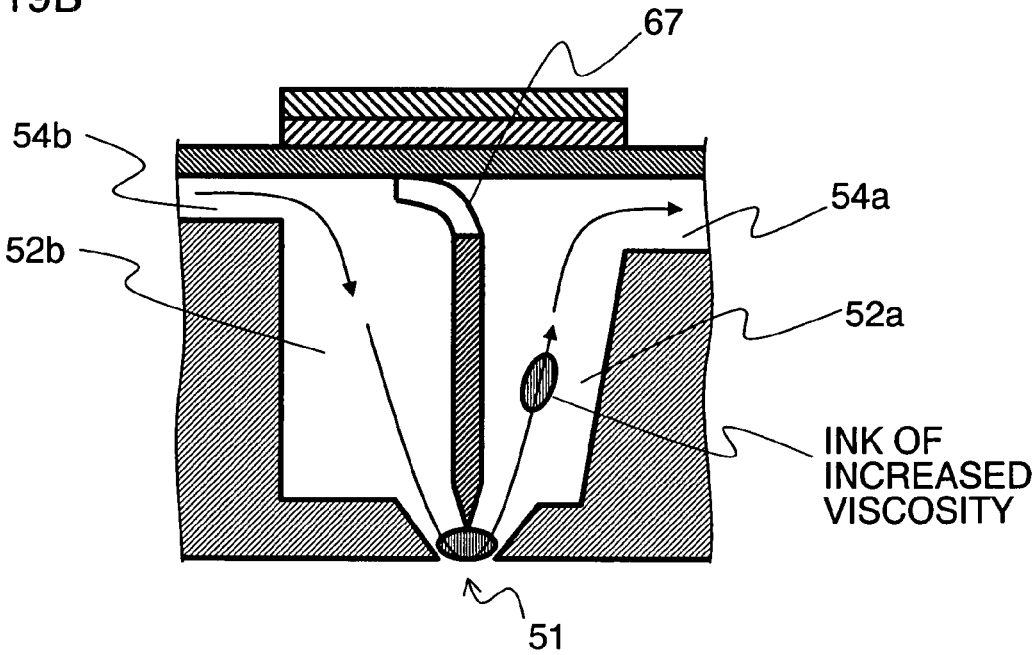

From the above, in the present embodiment, it is possible to reduce the pressure loss transmitted from the first pressure chamber 52*a* to the second pressure chamber 52*b*, or vice versa, and it is possible to implement the present embodiment efficiently. Moreover, when ink is caused to flow in the region of the nozzle 51 as described in the second embodiment, then by adopting the composition according to the present embodiment, the ink does not flow between the diaphragm 56 and the partition 59 as shown in FIG. 19B. Hence, it is possible to make the ink flow efficiently through the nozzle flow channel between the first nozzle region 51*a* and the second nozzle region 51*b*, and the ink can therefore be circulated efficiently.

Fifth Embodiment

Figure 20:
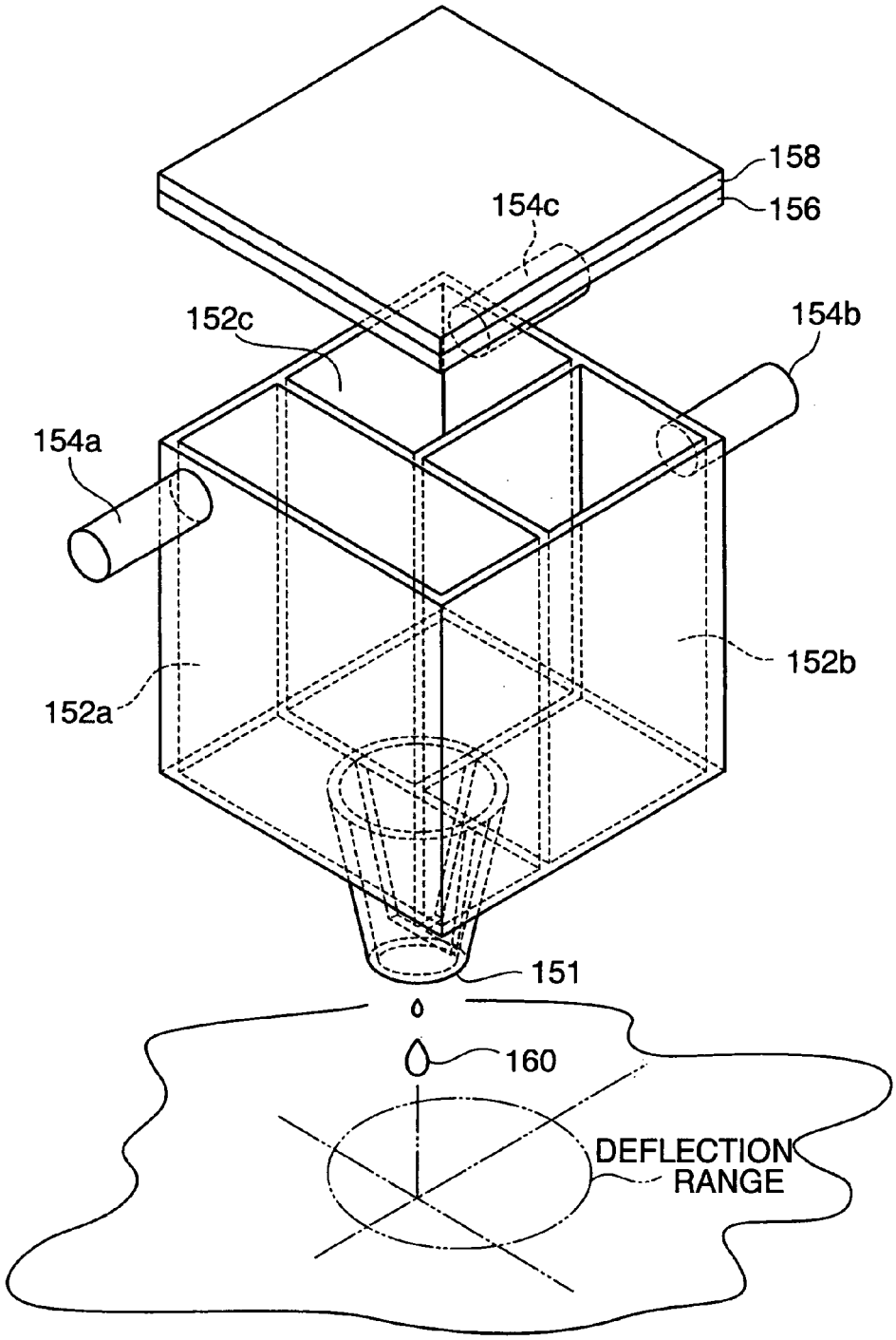
FIG. 20 is a perspective diagram of a liquid ejection head according to a fifth embodiment of the present invention.

FIG. 20 is a diagram showing an inkjet head according to a fifth embodiment. The first to fourth embodiments use a method which controls the ejection direction one-dimensionally, by forming two nozzle regions, namely, the first nozzle region and the second nozzle region, but in the fifth embodiment, the ejection direction is controlled two-dimensionally by further providing a third nozzle region and a third pressure chamber connected to this third nozzle region.

FIG. 20 shows the composition of an inkjet head according to the present embodiment in which two-dimensional deflection is possible. The control of the deflection is similar to that in the case of the one-dimensional deflection described in the first embodiment, or the like. For example, the control of the deflection is carried out in consideration of not only the first and second flow speeds shown in FIG. 6 but also a third flow speed which corresponds to the third pressure chamber and which has a longer vibration period than the first and second flow speeds. The combined ejection direction is determined on the basis of the combined vector that is derived from the ink flow vectors of the three pressure chambers. By changing the application time of the drive waveform to change the ratio of the three flow speeds, the ejection direction of the combined ink flowing from the three different pressure chambers is controlled.

A nozzle 151 ejecting an ink droplet 160 is divided into the first nozzle region, the second nozzle region and the third nozzle region. The first nozzle region is connected to a first pressure chamber 152*a*, the second nozzle region is connected to a second pressure chamber 152*b*, and the third nozzle region is connected to a third pressure chamber 152*c*. Moreover, the first pressure chamber 152*a*, the second pressure chamber 152*b* and the third pressure chamber 152*c* are connected to the common liquid chamber (not illustrated), via a first ink supply channel 154*a*, a second ink supply channel 154*b* and a third ink supply channel 154*c*, respectively, in such a manner that the three pressure chambers can receive the supply of ink. Each of the pressure chambers 152*a*, 152*b* and 152*c* has a wall which is constituted by a common diaphragm 156, a single piezoelectric layer 158 is formed on a side of the diaphragm 156 reverse to the side where the pressure chambers 152*a*, 152*b* and 152*c* are formed, and an upper electrode (not illustrated) is provided on top of this piezoelectric layer 158. The diaphragm 156, the piezoelectric layer 158 and the upper electrode constitute a piezoelectric element. By means of this composition, the direction of ink ejection can be controlled.

Figure 21:
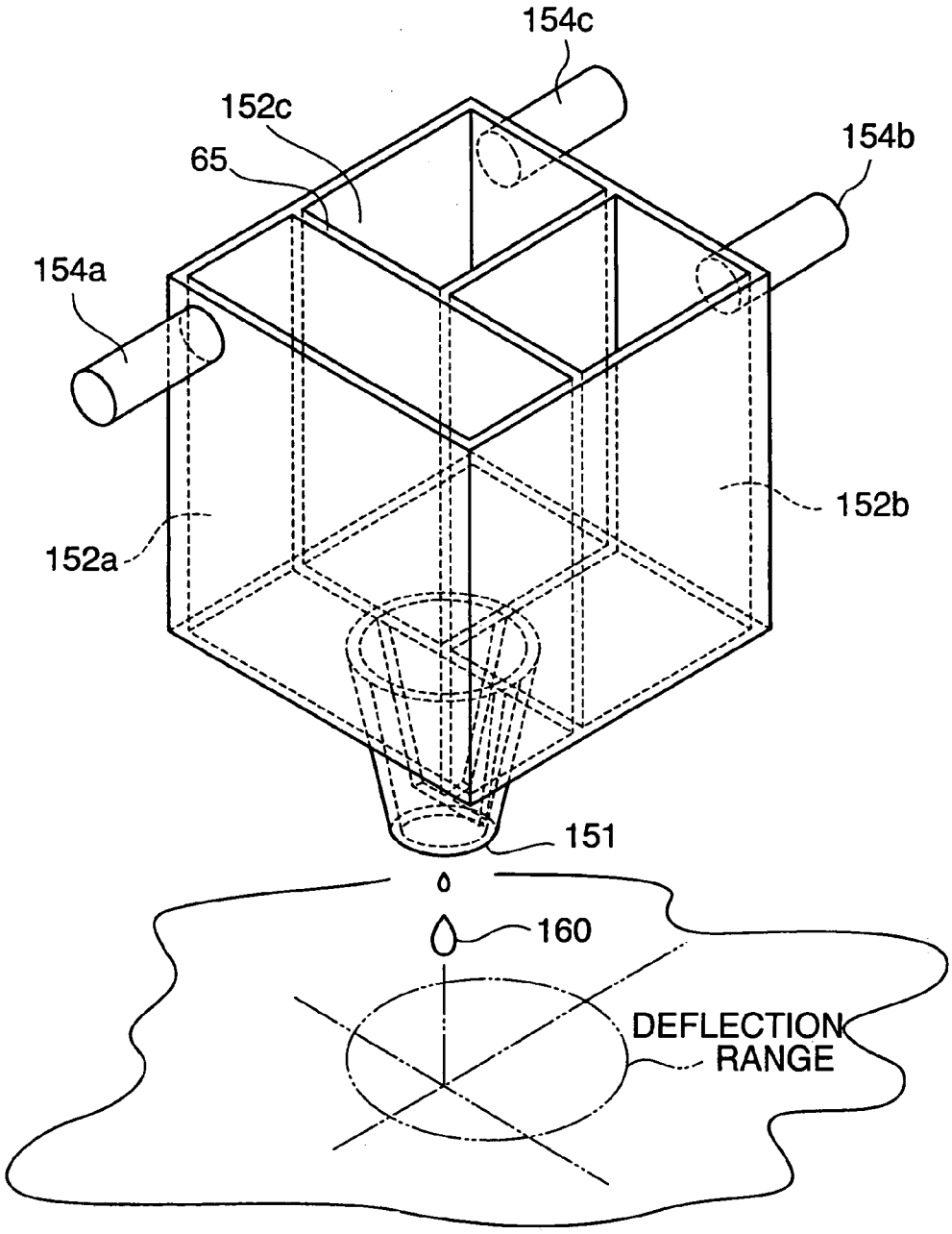
FIG. 21 is a perspective diagram of another liquid ejection head according to the fifth embodiment.

Furthermore, as shown in FIG. 21, by constituting the partition by means of a piezoelectric element 65 forming an actuator, it is possible to control the ejection direction in a two-dimensional fashion. The specific control method is similar to that used in the case of the third embodiment.

More specifically, the nozzle 151 ejecting an ink droplet 160 is divided into the first nozzle region, the second nozzle region and the third nozzle region. The first nozzle region is connected to the first pressure chamber 152*a*, the second nozzle region is connected to the second pressure chamber 152*b*, and the third nozzle region is connected to the third pressure chamber 152*c*. Moreover, the first pressure chamber 152*a*, the second pressure chamber 152*b* and the third pressure chamber 152*c* are connected to the common liquid chamber (not illustrated), via the first ink supply channel 154*a*, the second ink supply channel 152*b* and the third ink supply channel 154*c* respectively in such a manner that the three pressure chambers can receive the supply of ink. The vibration periods corresponding to the respective pressure chambers are mutually different. Moreover, all or a portion of the partition that demarcates the pressure chambers 152*a*, 152*b* and 152*c* are constituted by a piezoelectric element 65 forming an actuator, and the ink ejection direction is controlled by controlling the application time of the drive waveform applied to this piezoelectric element 65.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head which forms an image, comprising:

a nozzle from which liquid is ejected in a combination ejection direction and which includes a first nozzle region and a second nozzle region demarcated by a partition;

a pressure chamber unit which includes a first pressure chamber connected to the first nozzle region and a second pressure chamber connected to the second nozzle region, the first pressure chamber and the second chamber being demarcated by the partition; and a single piezoelectric element which vibrates the first pressure chamber at a first resonance frequency and the second pressure chamber at a second resonance frequency in accordance with an electric field applied to the single piezoelectric element, the first resonance frequency being different from the second resonance frequency, wherein:

the liquid in the first nozzle region is ejected in a first ejection direction at a first ejection speed and the liquid in the second nozzle region is ejected in a second ejection direction different from the second ejection direction at a second ejection speed in such a manner that the liquid ejected from the first nozzle region and the liquid ejected from the second nozzle region combine together at an end of the nozzle; and the combination ejection direction in which the liquid is ejected from the nozzle is controlled by adjusting a waveform of the electric field applied to the single piezoelectric element so that the first ejection speed of the liquid ejected from the first nozzle region is different from the second ejection speed of the liquid ejected from the second nozzle region.

2. The liquid ejection head as defined in claim 1, further comprising a diaphragm which forms a wall of the first pressure chamber and a wall of the second pressure chamber, wherein the single piezoelectric element is formed on a first surface of the diaphragm reverse to a second surface where the first pressure chamber and the second pressure chamber are formed.

3. The liquid ejection head as defined in claim 2, further comprising an elastic body provided between the diaphragm and the partition.

4. The liquid ejection head as defined in claim 1, wherein the partition is partially or entirely composed of the single piezoelectric element.

5. The liquid ejection head as defined in claim 1, further comprising a nozzle flow channel which connects the first nozzle region with the second nozzle region at the end of the nozzle, wherein the liquid flows between the first nozzle region and the second nozzle region via the nozzle flow channel, by making a first pressure in a first supply channel connected to the first pressure chamber different from a second pressure in a second supply channel connected to the second pressure chamber.

6. The liquid ejection head as defined in claim 1, wherein the combination ejection direction in which the liquid is ejected from the nozzle is controlled by adjusting an application time of the electric field applied to the single piezoelectric element.

7. The liquid ejection head as defined in claim 6, wherein an application end time when application of the electric field to the single piezoelectric element is halted, is kept substantially constant irrespective of the application time of the electric field.

8. The liquid ejection head as defined in claim 6, wherein the electric field applied to the single piezoelectric element is adjusted in such a manner that timing when the liquid is ejected from the nozzle is kept substantially constant irrespective of the application time of the electric field.

9. The liquid ejection head as defined in claim 6, wherein a magnitude of the electric field is controlled in accordance with the application time of the electric field applied to the single piezoelectric element so that a droplet volume of the liquid ejected from the nozzle is kept substantially constant.

10. The liquid ejection head as defined in claim 1, wherein:

the nozzle further includes a third nozzle region demarcated by the partition;

the pressure chamber unit further includes a third pressure chamber which is demarcated by the partition and which is connected to the third nozzle region;

the single piezoelectric element vibrates the third pressure chamber at a third resonance frequency in accordance with the electric field applied to the single piezoelectric element, the third resonance frequency being different from the first resonance frequency and the second resonance frequency;

the liquid in the third nozzle region is ejected in a third ejection direction at a third ejection speed in such a manner that the liquid ejected from the first nozzle region, the liquid ejected from the second nozzle region and the liquid ejected from the third nozzle region combine together at the end of the nozzle, the third ejection direction being different from the first ejection direction and the second ejection direction; and the combination ejection direction of the liquid ejected from the nozzle is controlled by adjusting the waveform of the electric field applied to the single piezoelectric element so that the first ejection speed of the liquid ejected from the first nozzle region, the second ejection speed of the liquid ejected from the second nozzle region and the third ejection speed of the liquid ejected from the third nozzle region are different from each other.

11. A liquid ejection apparatus comprising the liquid ejection head as defined in claim 1.

12. An image forming apparatus comprising the liquid ejection head as defined in claim 1.

* * * * *